US009947282B2

(12) United States Patent
Choi

(10) Patent No.: US 9,947,282 B2
(45) Date of Patent: Apr. 17, 2018

(54) GATE DRIVER, DISPLAY DRIVER CIRCUIT, AND DISPLAY DEVICE INCLUDING SAME

(71) Applicant: Chul-Ho Choi, Seoul (KR)

(72) Inventor: Chul-Ho Choi, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 44 days.

(21) Appl. No.: 15/046,519

(22) Filed: Feb. 18, 2016

(65) Prior Publication Data

US 2016/0267868 A1 Sep. 15, 2016

(30) Foreign Application Priority Data

Mar. 13, 2015 (KR) ..... 10-2015-0035151

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 3/3674* (2013.01); *G09G 3/3688* (2013.01); *G09G 3/3614* (2013.01); *G09G 2310/0213* (2013.01); *G09G 2310/0297* (2013.01); *G09G 2320/103* (2013.01); *G09G 2330/023* (2013.01)

(58) Field of Classification Search
CPC ... G06F 3/0416; G06F 3/0412; G09G 3/3648; G09G 3/3266; G09G 3/3611; G09G 3/3688; G09G 3/3677; G09G 2330/021; G09G 2310/08; G09G 2310/0213; G09G 2360/16; G09G 2320/103; G09G 2310/0297; G09G 2310/027; G09G 3/3614; G09G 5/18
See application file for complete search history.

(56) References Cited

U.S. PATENT DOCUMENTS 6,340,960 B1 1/2002 Song et al.
6,995,742 B2 * 2/2006 Park ..... G09G 3/20 345/100
7,196,685 B2 * 3/2007 Lee ..... G09G 3/2011 345/100
7,710,377 B2 * 5/2010 Kang ..... G09G 3/3614 345/209

(Continued)

FOREIGN PATENT DOCUMENTS

JP 2005-292286 10/2005
KR 1020090127771 A 12/2009

(Continued)

*Primary Examiner* — Dismery Mercedes
(74) *Attorney, Agent, or Firm* — Volentine & Whitt, PLLC

(57) ABSTRACT

A display driver circuit including a gate driver driving gate lines of a display panel according to a driving order. The gate lines are disposed in an ordered arrangement within the display panel. A source driver converts image data corresponding to a selected gate line into an image signal and outputs the image signal to a source line of the display panel. A timing controller calculates comparison values by comparing a first image data portion corresponding to a first gate line with image data portions respectively corresponding to gate lines of the plurality of gate lines. The timing controller sets the driving order for the gate lines in response to the comparison values.

18 Claims, 26 Drawing Sheets

(56) References Cited

U.S. PATENT DOCUMENTS

| | | | | |
|---|---|---|---|---|
| 8,866,799 | B2 * | 10/2014 | Jun | G09G 3/36 345/204 |
| 9,236,018 | B2 * | 1/2016 | Nakanishi | G09G 3/3648 |
| 2004/0080480 | A1 * | 4/2004 | Zhang | G09G 3/3688 345/90 |
| 2008/0062072 | A1 * | 3/2008 | Yang | G09G 3/2092 345/55 |
| 2014/0009458 | A1 * | 1/2014 | Nam | G09G 3/3696 345/212 |
| 2014/0152716 | A1 * | 6/2014 | Lee | G09G 3/2022 345/691 |
| 2014/0184977 | A1 | 7/2014 | Uehara et al. | |
| 2014/0204070 | A1 * | 7/2014 | Lin | G09G 3/3677 345/212 |
| 2014/0225877 | A1 * | 8/2014 | Nakanishi | G09G 3/3648 345/204 |
| 2015/0106646 | A1 * | 4/2015 | Lee | G09G 3/3677 713/400 |
| 2015/0116303 | A1 * | 4/2015 | Lee | G09G 3/3233 345/212 |
| 2015/0269889 | A1 * | 9/2015 | Hsu | G09G 3/3266 345/690 |

FOREIGN PATENT DOCUMENTS

| | | |
|---|---|---|
| KR | 10-0969628 | 7/2010 |
| KR | 1020120073793 A | 7/2012 |
| KR | 10-1205413 A | 11/2012 |

* cited by examiner

<Straight Panel>

<Zig-Zag Panel>

GATE DRIVER, DISPLAY DRIVER CIRCUIT, AND DISPLAY DEVICE INCLUDING SAME

CROSS-REFERENCE TO RELATED APPLICATION

This application claims the benefit of Korean Patent Application No. 10-2015-0035151 filed on Mar. 13, 2015, the subject matter of which is hereby incorporated by reference.

BACKGROUND

Embodiments of the inventive concept relate generally to semiconductor devices, and more particularly, to gate drivers that drive a display panel. Other embodiments of the inventive concept relate to display driver circuits and display devices including at least one display driver circuit.

A display device includes a display panel that displays images and a display driver circuit that drives one or more electrical signals associated with the display panel. In its operation, a display driver circuit receives image data from a host, performs image processing on the received image data, and drives the display panel by applying a voltage signal to a source line of the display panel based on the image-processed image data. As the size and resolution of contemporary display panel increase, various technologies are being studied to reduce power consumption of the display driver circuit.

SUMMARY

The inventive concept provides a display driver circuit for reducing dynamic power consumption and improving heat dissipation characteristics.

The inventive concept provides a display device for reducing dynamic power consumption and improving heat dissipation characteristics.

According to an aspect of the inventive concept, there is provided a display driver circuit including: a gate driver configured to sequentially select gate lines of a display panel; a source driver configured to convert image data corresponding to a selected gate line into an image signal and output the image signal to a source line of the display panel; and a timing controller configured to calculate N comparison values by comparing first image data corresponding to a first gate line with image data corresponding to each of N gate lines selected after the first gate line and determine an driving order for the N gate lines based on the N comparison values (where N is an integer that is equal to or greater than 2).

The timing controller may determine the order of selection so that the N gate lines are sequentially selected depending on an order of their closeness to the first gate line regardless of the N comparison values when a maximum value of the N comparison values is less than a predetermined threshold value, and may determine the order of selection so that the N gate lines are selected depending on an order of ascending comparison values (i.e., an order starting from the smallest comparison value) when the maximum value of the N comparison values is equal to or greater than the predetermined threshold value.

The timing controller may generate a selection control signal, which indicates the order of selection and varies according to a pattern of an image which is displayed on the display panel, and may provide the selection control signal to the gate driver.

The timing controller may include a selection control logic unit configured to compare the first image data with the N pieces of image data corresponding to the N gate lines and generate a selection control signal indicating the driving order for the N gate lines.

When image data received from the outside is a moving image, the timing controller may block an operation of the selection control logic unit and control the gate driver so that the gate lines are sequentially selected.

When image data received from the outside is a still image, the selection control logic unit may perform a calculation operation for a comparison of image data in a first frame period of a plurality of frame periods in which the still image is displayed, and may not perform the calculation operation in the other frame periods.

When at least two comparison values have the same value, the timing controller may set the order of selection so that a gate line physically adjacent to the first gate line from among gate lines corresponding to the at least two comparison values is selected first.

The N gate lines may include a second gate line and a third gate line, wherein the timing controller may compare the first image data with each of second and third image data corresponding to the second and third gate lines and select the order of selection so that among the second and third gate lines, a gate line including image data having a relatively small data difference with respect to the first image data is selected first.

The N gate lines may include a second gate line, a third gate line, and a fourth gate line, wherein the timing controller may compare the first image data with each of second through fourth image data corresponding to the second through fourth gate lines, respectively, and select the order of selection so that among the second through fourth gate lines, a gate line including image data having a relatively smallest data difference with respect to the first image data is selected first and a gate line including image data having a relatively largest data difference with respect to the first image data is selected last.

The first gate line may be a gate line that is selected last from among other N gate lines which are selected before the N gate lines.

The first gate line may be a gate line set to be selected first from among the plurality of gate lines.

The timing controller may calculate N comparison values by comparing image data corresponding to a gate line selected last from among the N gate lines with image data corresponding to each of other N gate lines selected after the N gate lines, and may determine the order of selection so that the other N gate lines are selected depending on an order of ascending comparison values (i.e., an order starting from the smallest comparison value).

The timing controller may sequentially provide a first selection control signal indicating the driving order for the N gate lines and a second selection control signal indicating the driving order for the other N gate lines to the gate driver.

The gate driver may include: a shift register configured to generate a plurality of shift pulses; a level shifter configured to shift voltage levels of the plurality of shift pulses and to output signals having shifted voltage levels; an output buffer configured to generate a plurality of scan pulses based on the signals output from the level shifter and provide the plurality of scan pulses to the plurality of gate lines; and a multiplexer configured to receive a selection control signal indicating the driving order for the plurality of gate lines from the timing controller and set a connection relation between a plurality of outputs of the shift register and a plurality of inputs of the level shifter in response to the selection control signal.

The selection control signal may include a first selection control signal and a second selection control signal which are sequentially provided to the multiplexer, wherein the multiplexer may include: a first multiplexer configured to set a connection relation between N outputs of the shift register and N inputs of the level shifter in response to the first selection control signal; and a second multiplexer configured to set a connection relation between other N outputs of the shift register and other N inputs of the level shifter in response to the second selection control signal.

The second selection control signal may be received after the first multiplexer transmits N shift pulses to the level shifter.

According to another aspect of the inventive concept, there is provided a display device including: a display panel including a plurality of pixels positioned in a region in which a plurality of gate lines arranged in a column direction and a plurality of source lines arranged in a row direction cross each other; a gate driving unit configured to sequentially drive the plurality of gate lines depending on a order of driving; a source driver configured to output an image signal corresponding to a selected gate line to the plurality of source lines; and a timing controller configured to compare each of N pieces of comparison image data corresponding to N gate lines of a K-th group with reference image data corresponding to a gate line selected last from among gate lines of a (K−1)-th group and set the order of driving of the N gate lines of the K-th group based on the comparison result, where 'K' and 'N' are integers that are equal to or greater than 2.

The timing controller may provide a control signal indicating the order of driving to the gate driving unit, and the gate driving unit may drive the N gate lines of the K-th group depending on the predetermined order of driving in response to the control signal.

The gate driving unit may include a plurality of gate drivers each receiving the control signal, and the plurality of gate drivers may be implemented by different semiconductor chips.

The display panel may include: a straight type of panel in which pixels arranged in the same column from among the plurality of pixels are connected to the same source line; or a zig-zag type of panel in which among the pixels arranged in the same column, pixels arranged in an odd column are connected to a first source line of first and second source lines arranged at both sides of the pixels and pixels arranged in an even column are connected to the second source line.

The timing controller may reset an order in which the N pieces of comparison image data are output, based on the order of driving of the N gate lines.

According to another aspect of the inventive concept, there is provided a gate driver for driving a plurality of gate lines of a display panel so that an image is displayed on the display panel, the gate driver including: a shift register configured to generate a plurality of shift pulses; a level shifter configured to shift voltage levels of the plurality of shift pulses and to output signals having shifted voltage levels; an output buffer configured to provide the signals output from the level shifter to the plurality of gate lines; and a multiplexer configured to set a connection relation between a plurality of outputs of the shift register and a plurality of inputs of the level shifter in response to a selection control signal that varies according to a pattern of the image.

BRIEF DESCRIPTION OF THE DRAWINGS

Certain embodiments of the inventive concept are described in the following detailed description taken in conjunction with the accompanying drawings in which.

DETAILED DESCRIPTION

Figure 1:
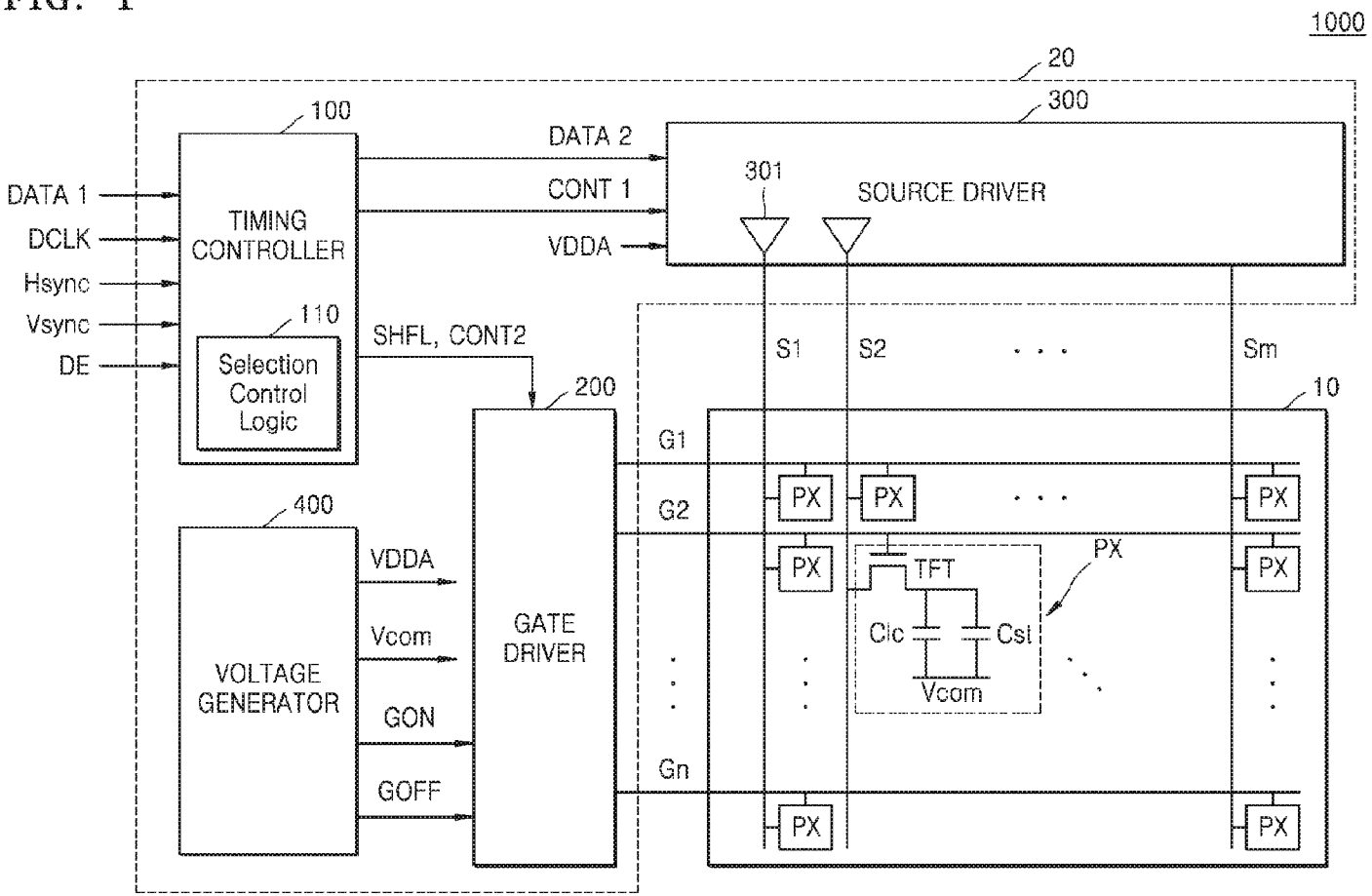
FIG. 1 is a block diagram of a display device according to an embodiment of the inventive concept.

Embodiments of the inventive concept will now be described in some additional detail with reference to the accompanying drawings. The illustrated embodiments are provided so that this disclosure is thorough and complete and fully conveys the scope of the inventive concept to one skilled in the art. Accordingly, while the inventive concept can be modified in various ways and take on various alternative forms, specific embodiments thereof are shown in the drawings and described in detail below as examples. There is no intent to limit the inventive concept to the particular forms disclosed. On the contrary, the scope of the inventive concept should be construed as covering all modifications, equivalents, and alternatives. Throughout the written description and drawings, like reference number denote like or similar elements, steps, features, etc.

It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

As used herein, the term "or" includes any and all combinations of one or more of the associated listed items. For example, the expression "A or B" may include A, B, or both A and B. Expressions such as "at least one of," when preceding a list of elements, modify the entire list of elements and do not modify the individual elements of the list.

It will be understood that, although the terms first, second, etc. may be used herein to describe various elements, components, regions, layers and/or sections, these elements, components, regions, layers and/or sections should not be limited by these terms. Thus, a first element, component, region, layer or section discussed below could be termed a second element, component, region, layer or section without departing from the teachings of the inventive concept.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements.

The terminology used herein is for the purpose of describing particular embodiments only and is not intended to be limiting of example embodiments. As used herein, the singular forms "a", "an", and "the" are intended to include the plural forms as well, unless the context clearly indicates otherwise.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A display device according to various embodiments of the inventive concept may be an electronic device having an image display function. For example, the electronic device may include at least one of a smartphone, a tablet PC, a mobile phone, a video phone, an e-book reader, a desktop PC, a laptop PC, a netbook computer, a personal digital assistant (PDA), a portable multimedia player (PMP), an MPEG-1 audio layer 3 (MP3) player, a mobile medical device, a camera, or a wearable device, such as a head-mounted device (HMD) (e.g., electronic glasses), electronic clothes, an electronic bracelet, an electronic necklace, an electronic appcessory, electronic tattoos, or a smart watch.

In certain embodiments, the display device may be a smart home appliance having an image display function. The smart home appliance may include, for example, at least one of a TV, a DVD player, an audio player, a refrigerator, an air conditioner, a vacuum cleaner, an oven, a microwave oven, a washing machine, an air freshener, a set-top box, a TV box (e.g., Samsung HomeSync™, Apple TV™, or Google TV™), game consoles, an electronic dictionary, an electronic key, a camcorder, or an electronic frame.

In some embodiments, the display device may include at least one of various medical devices (e.g., magnetic resonance angiography (MRA), magnetic resonance imaging (MRI), computed tomography (CT), an imaging device, or an ultrasonic device), a navigation device, a global positioning system (GPS) receiver, an event data recorder (EDR), a flight data recorder (FDR), an in-vehicle infotainment device, marine electronic equipment (e.g., a marine navigation device and a gyrocompass), an aerial electronic device (avionics), a security device, a car head unit, an industrial or household robot, an automatic teller machine (ATM) of a financial institution or a point of sales (POS) of a store.

In some embodiments, the display device may include at least one of furniture or a portion of a building/structure, which has an image display function, an electronic board, an electronic signature receiving device, a projector, or various measuring devices (e.g., tap water, electricity, gas, and radio-wave measuring devices). An electronic device including the display device according to the various embodiments of the inventive concept may be one or a combination of the above-described various apparatuses. Also, the display device may be a flexible apparatus. It will be understood that the display device according to various embodiments of the inventive concept is not limited to the above-described apparatuses.

Hereinafter, display devices according to various embodiments of the inventive concept will be described with reference to the appended drawings. In the various embodiments, the term "user" may refer to a user of a display device or a device (e.g., an artificial intelligence (AI) electronic device) using the display device.

FIG. 1 is a block diagram illustrating of a display device 1000 according to an embodiment of the inventive concept. Referring to FIG. 1, the display device 1000 generally includes a display panel 10 and a display driver circuit 20.

The display panel 10 includes a plurality of pixels arranged in a matrix and configured to display images in frame units. The display panel 10 may be embodied by one selected from a liquid crystal display (LCD), a light emitting diode (LED) display, an organic LED (OLED) display, an active-matrix OLED (AMOLED) display, an electrochromic display (ECD), a digital mirror device (DMD), an actuated mirror device (AMD), a grating light value (GLV), a plasma display panel (PDP), an electro-luminescent display (ELD), and a vacuum fluorescent display (VFD), or embodied by one of other kinds of flat-panel displays (FPDs) or flexible displays. The illustrated embodiment of FIG. 1 describes the display panel 10 under the assumption that the display panel is an LCD panel.

The display panel 10 shown in FIG. 1 is further assumed to include gate lines G1 to Gn arranged in a row direction, source lines S1 to Sm arranged in a column direction, and respective pixels PX formed at intersections between the gate lines G1 to Gn and the source lines S1 to Sm. Here, each of the pixels PX may include a thin-film transistor (TFT) and a liquid crystal (LC) capacitor Clc and a storage capacitor Cst connected to a drain of the TFT. A common voltage Vcom may be applied to the other terminals of the LC capacitor Clc and the storage capacitor Cst. When the gate lines G1 to Gn are sequentially scanned, a TFT of a pixel PX connected to a selected gate line may be turned ON, and a gradation voltage corresponding to pixel data may be applied to each of the source lines S1 to Sm. The gradation voltage may be applied through the TFT of the corresponding pixel PX to the LC capacitor Clc and the storage capacitor Cst, and the LC capacitor Clc and the storage capacitor Cst may be driven to enable a display operation.

The display driver circuit 20 shown in FIG. 1 may be used to generate a driving signal that is used for displaying an image corresponding to image data DATA1 to the display panel 10, based on the image data DATA1 and externally provided control signals. These externally provided control signals may include (e.g.,) a horizontal synchronous signal—Hsync, a vertical synchronous signal—Vsync, a clock signal DCLK, a data enable signal DE, etc. The display driver circuit 20 includes a timing controller 100, a gate driver 200, a source driver 300, and a voltage generator 400, where the display driver circuit 20 may be embodied as a single semiconductor chip or a plurality of semiconductor chips.

The timing controller 100 may receive the image data DATA1 and externally provided control signals from a devices, such as a host device (not shown). In response to the image data DATA1 and externally provided control signals, the timing generator generates control signals CONT1, CONT2, and SHFL for controlling the gate driver 200 and the source driver 300. The timing controller 100 may also be used to convert the format of certain externally provided image data DATA1 to meet specifications for an interface associated with the source driver 300. Thus, converted image data DATA2 may be communicated from the timing controller 100 to the source driver 300. This type of data communication may be performed using one or more defined (e.g., packetized) data formats.

The timing controller 100 may further be used to set an order of selection for the gate lines G1 to Gn. That is, a particular "driving order" may be set for the plurality of gate lines G1 to Gn, wherein said driving order is set in accordance with a characteristic of the image data DATA1 and/or in accordance with a pattern of the image to be displayed on the display panel 10 in response to the image data DATA1 (hereafter, "image data pattern"). In this regard a particular driving order set by the timing controller 100 may selectively drive the gate lines G1 to Gn in a sequential, partially sequential, or non-sequential manner relative an "ordered arrangement" (e.g., a physical layout) of the gate lines.

The timing controller 100 may also be used to analyze the image data pattern by comparing multiple portions of the image data (hereafter, "image data portion(s)") including image data portions assigned to at least two (2) physically adjacent gate lines within the ordered arrangement of the display panel 10. When a data difference identified by this comparison of image data portions is deemed to be relatively large, the timing controller 100 may select the gate lines in a non-sequential manner, such that gate lines having a small data difference there between are continuously selected.

For example, assuming a simple ordered arrangement of three (3) gate lines including first gate line G1 adjacent to a second gate line G2, adjacent to a third gate line G3, when a first data difference between a first image data portion corresponding to the first gate line G1 and a second image data portion corresponding to the second gate line G2 is relatively larger than a second data difference between the first image data portion and a third image data portion corresponding to the third gate line G3, the timing controller 100 may set a non-sequential driving order for the gate lines, such that the third gate line G3 is driven after the first gate line G1 (instead of the second gate line G2), and the second gate line G2 is driven after the third gate line G3. In other words, the timing controller 100 may "rank" a plurality of data differences in some assigned order (e.g., an ascending order from lowest to highest), and then use the ranked data differences to define a corresponding driving order for the gate lines associated with the respective data differences.

In the foregoing description, the terms "image data" and/or "image data portion" denotes all or some of the pixel data that indicates a gradation voltage applied to some or all of the pixels connected to a corresponding gate line. In some embodiments, image data may be pixel data corresponding to all pixels connected to a particular gate line. In some other embodiments, image data may be pixel data corresponding to only some of pixels connected to a gate line. In still other embodiments, image data may be certain upper bits of multi-bit image data units included in the pixel data.

In the illustrated embodiment of FIG. 1, the timing controller 100 includes a selection control logic unit 110 that may be used to set a driving order that correspondingly selects gate lines from among the gate lines G1 to Gn according to an image data pattern. The selection control logic unit 110 may be used to calculate one or more comparison value(s) by comparing image data corresponding to a reference gate line with image data corresponding to one or more gate line(s) to be selected after the selection of the reference gate line, and set a driving order that selects among the gate lines based on the calculated comparison value(s).

In some embodiments, the selection control logic unit 110 may set the driving order for the gate lines in accordance with an ascending order of comparison values (e.g., a driving order for gate lines beginning with a first gate line associated with a smallest comparison value up to a last gate line associated with a greatest comparison value). In this manner, the selection control logic unit 110 may set a driving order for the gate lines, such that a gate line corresponding to an image data portion having a smallest data difference with respect to an image data portion corresponding to the reference gate line will be selected first in the driving order.

Extending the foregoing example, the selection control logic unit 110 may be used to essentially reset the reference gate line to be the last-selected gate line following each gate line selection. Thus, once selected, a first gate line may be designated as the reference gate line for selection of a next (second) gate line having the next smallest comparison value. For example, the selection control logic unit 110 may calculate a next comparison value by comparing the image data portion corresponding to the first gate line (now the new reference gate line) with respective image data portions corresponding to the remaining (not previously selected) gate lines. Upon identifying a smallest comparison value under these conditions, the selection control unit 110 may select an appropriate next (second) gate line. Thereafter, during the selection of the next (third) gate line in the driving order, the second gate line is designated as the new reference gate line, and so on until the selection control logic unit 110 sets a complete driving order for the plurality of gate lines.

Hereinafter, an approach by which the selection control logic unit 110 sets a non-sequential driving order for the gate lines based upon a determination of an image data pattern (e.g., a first image data pattern associated with a still image verses a second image data pattern associated with a moving image), rather than setting a sequential driving order dictated by their ordered arrangement. This choice of non-sequential verses sequential driving order may be referred to as a "gate line selection control operation". In addition, an operating mode wherein gate lines are sequentially selected in accordance with their ordered arrangement will be referred to as a "default gate line selection mode", while an operating mode wherein gate lines may be non-sequentially selected with respect to their ordered arrangement will be a "shuffle gate line selection mode".

Thus, in some embodiments, the selection control logic unit 110 may compare a greatest comparison value with a predetermined threshold value to thereby determine whether to perform a gate line selection control operation. For example, when the greatest comparison value among a plurality of comparison values is less than the predetermined threshold value, the selection control logic unit 110 may determine that a gate line selection control operation is not needed. Thereafter, the timing controller 100 may operate in the default gate line selection mode and set a sequential driving order for the gate lines, regardless of the respective comparison values in the plurality of comparison values, other than the greatest comparison value. In contrast, when the greatest comparison value among the plurality of comparison values is greater than or equal to the predetermined threshold value, the control selection control logic unit 110 may determine that a gate line selection control operation is needed. Thereafter, the timing controller 100 may operate in the shuffle gate line selection mode and set a non-sequential driving order for the gate lines.

As further illustrated in FIG. 1, the selection control logic unit 110 may be used to set a driving order for gate lines G1 to Gn and generate a corresponding selection control signal SHFL indicating the driving order. The selection control logic unit 110 may provide the selection control signal SHFL and a corresponding set of control signal(s) to the gate driver 200.

Collectively, the gate driver 200 and source driver 300 drive the pixels PX of the display panel 10 in response to a first control signal CONT1 and a second control signal CONT2, as well as the selection control signal SHFL provided by the timing controller 100. Here, the first control signal CONT1 and the second control signal CONT2 may be one or more control signals, control packets, and/or reference signals (e.g., a clock signal, a voltage reference, reference data).

In the embodiment of FIG. 1, the gate driver 200 receives the selection control signal SHFL and the second control signal CONT2, where the control signal CONT2 may include a vertical start signal STV for directing the output start of a gate-on pulse (or a scan pulse) and a gate clock signal (CPV) for controlling the output time point of the gate-on pulse. The gate-on pulse is a signal indicating a period in which a gat-on voltage GON is applied to the gate lines G1 to Gn. The gate lines G1 to Gn of the display panel 10 may be sequentially selected in response to the gate-on pulse. However, the gate driver 200 may change an order in which the gate-on pulse is applied to the gate lines G1 to Gn in response to the selection control signal SHFL. The gate driver 200 may apply the gate-on voltage GON to a selected gate line to activate the selected gate line.

The source driver 300 outputs a gradation voltage for each of pixels connected to an activated gate line. Accordingly, the display panel 10 may display images in units of horizontal lines or row units.

The source driver 300 drives the source lines S1 to Sm of the display panel 10 in response to the first control signal CNT1 that is a source driver control signal. The source driver 300 generates a gradation voltage and outputs a gradation voltage corresponding to the image data DATA2 to the source lines S1 to Sm of the display panel 10.

The voltage generator 400 may generate voltages used by the display driver circuit 20 and/or the display panel 10. The voltage generator 400 may generate a gate-on voltage GON, a gate-off voltage GOFF, a common voltage Vcom, and an analog power supply voltage VDDA. The gate-on voltage GON and the gate-off voltage GOFF may be provided to the gate driver 200 and used to generate a scan pulse to be applied to the gate lines G1 to Gj. The common voltage Vcom may be equally provided to the pixels PX of the display panel 10. As shown in FIG. 1, the common voltage Vcom may be provided to one terminal of an LC capacitor Clc and one terminal of a storage capacitor Cst. The analog power supply voltage VDDA may be provided to the source driver 300.

Although not illustrated in FIG. 1, the display driver circuit 20 may further include an interface. The display driver circuit 20 may communicate with an external device via the interface. The interface may include, for example, an RGB interface, a CPU interface, a serial interface, a mobile display digital interface (MDDI), an inter integrated circuit (I2C) interface, a serial peripheral interface (SPI), a micro-controller unit (MCU) interface, a mobile industry processor interface (MIPI), an embedded displayport (eDP) interface, a D-subminiature (D-sub), an optical interface, or a high-definition multimedia interface (HDMI). Additionally, the interface may include, for example, a mobile high-definition link (MHL) interface, a secure digital (SD) card/multi-media card (MMC) interface, or an infrared data association (IrDA) standard interface. Further, the interface may include one of various serial or parallel interfaces besides the above-stated interfaces.

In the display device 1000 shown in FIG. 1, respective gate lines comparatively receiving image data portions characterized by relatively small differences there between may be continuously selected since the timing controller 100 is able to control the driving order for the gate lines G1 to Gn according to an image data pattern. Accordingly, a voltage difference between gradation voltages that are output in units of horizontal lines from the source driver 300 will also be small under such conditions, and a number of times that the gradation voltages output by the source driver 300 within one frame is severely changed may be reduced. That is, a number of relatively large output transitions for the source driver 300 may be reduced, thereby reducing overall power consumption.

Indeed, the dynamic power of an output buffer 301 included in the source driver 300 may be represented by Equation 1:

$$P = \frac{1}{2} \cdot C_{Load} \cdot V_{Supply} \cdot V_{Swing} \cdot (\alpha \cdot f_{1H}), \tag{1}$$

where $C_{Load}$ denotes a load capacitor, $V_{Supply}$ denotes a power supply voltage applied to the output buffer 301, $V_{Swing}$ denotes a dynamic swing voltage of the output buffer 301, that is, a maximum variation in the output of the output buffer 301, and $\alpha$ denotes a transition probability that the output of the output buffer 301 will transition, and $f_{1H}$ denotes a horizontal line frequency.

The load capacitor $C_{Load}$ may be determined depending on the size of the display panel 10, the power supply voltage $V_{Supply}$ may be determined depending on a contrast ratio, the dynamic swing voltage $V_{Swing}$ may be determined depending on gamma characteristics of the display panel 10, and the horizontal line frequency $f_{1H}$ may be determined depending on the type, frame frequency, and resolution of the display panel 10. The load capacitor $C_{Load}$, the power supply voltage $V_{Supply}$, the dynamic swing voltage $V_{Swing}$, and the horizontal line frequency $f_{1H}$ each may have a fixed value depending on characteristics of the display panel 10.

The transition probability α may be determined depending on a pattern of an image to be displayed on the display panel 10 and the driving order for gate lines. Accordingly, the order of gate line selection may be changed depending on an image data pattern and thus the transition probability α of the output buffer 301 may be reduced. As a result, the dynamic power of the output buffer 301 and dynamic power of the source driver 300 may be reduced. In addition, since the dynamic power of the output buffer 301 and dynamic power of the source driver 300 are reduced, the amount of heat occurring when the display driver circuit 20 drives the display panel 10 may be reduced.

Hereinafter, an operation of the display device 1000 according to an embodiment of the inventive concept will be described in some additional detail with reference to FIGS. 2 through 16.

Figure 2:
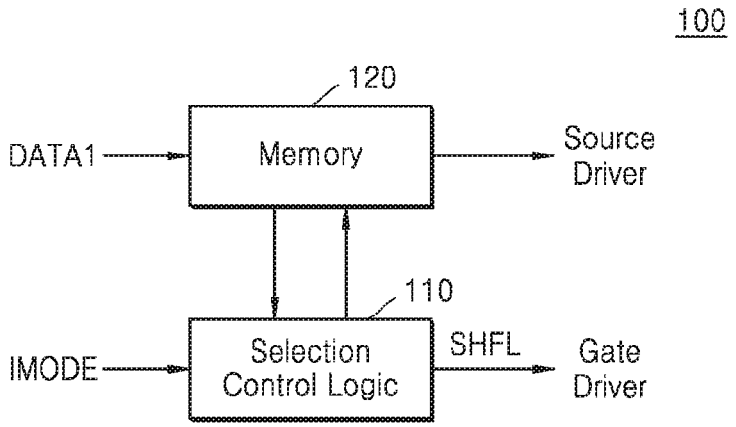
FIG. 2 is a block diagram further illustrating the timing controller of FIG. 1.
Figure 3:
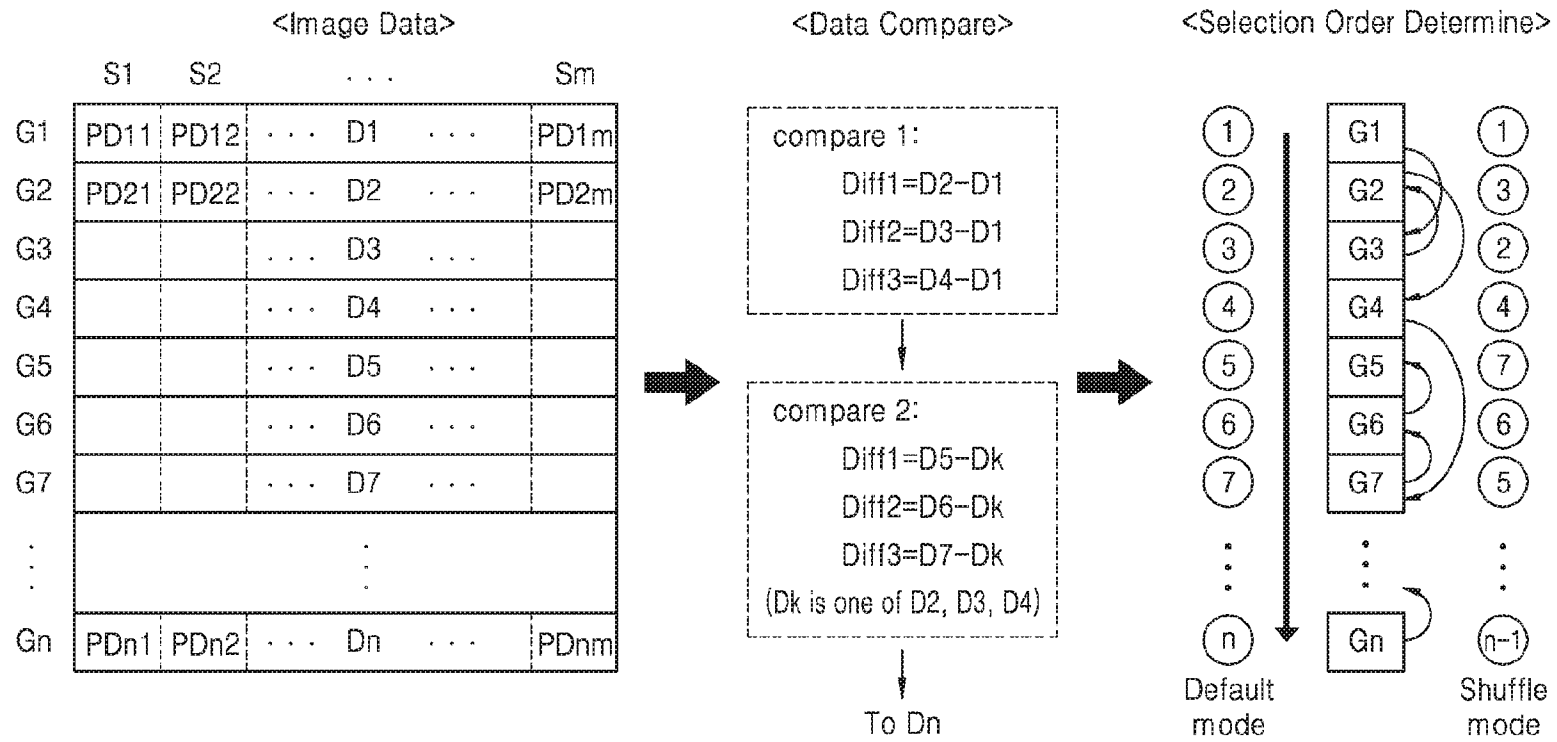
FIG. 3 is a conceptual diagram illustrating operation of the timing controller of FIG. 1.
Figure 4:
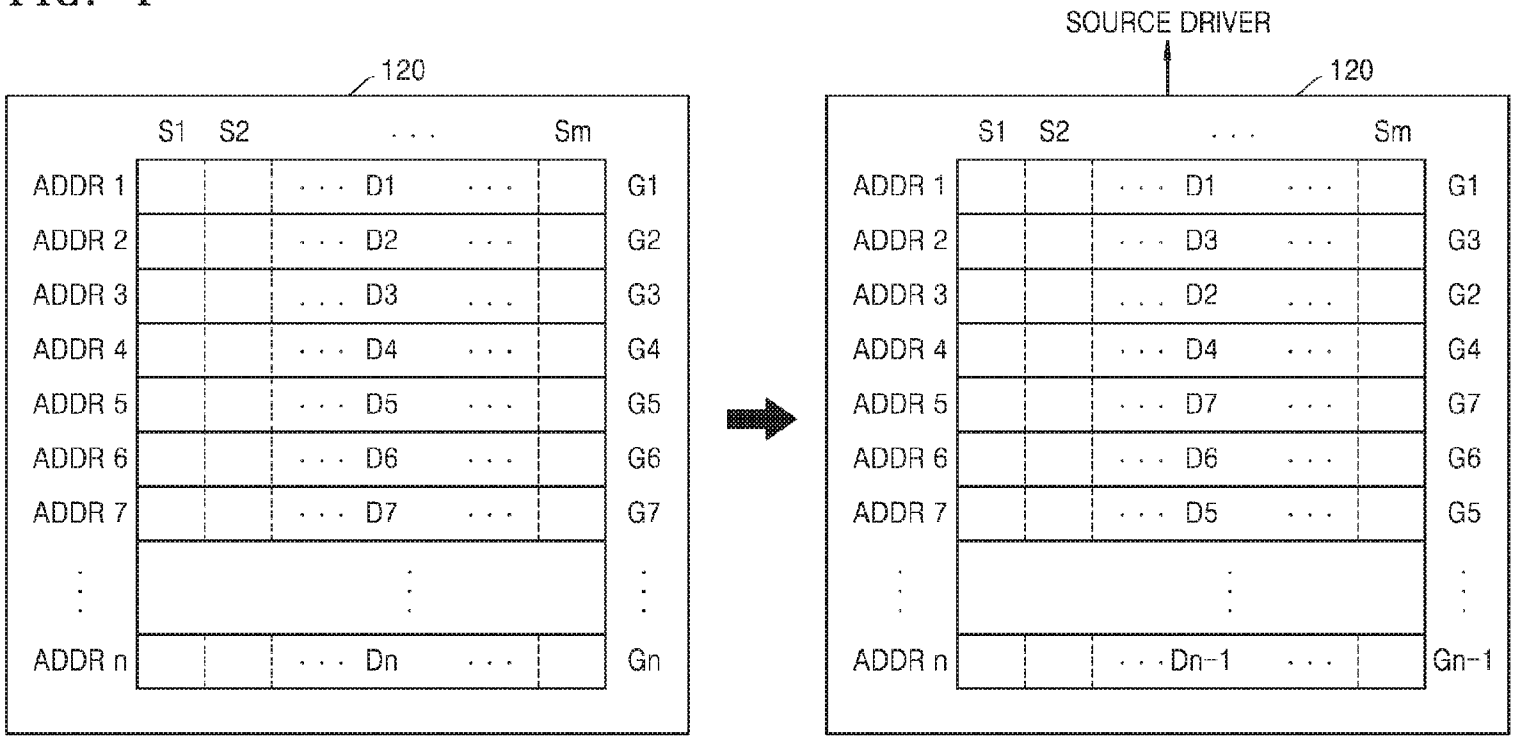
FIG. 4 is a conceptual diagram illustrating image data stored in a memory of the timing controller of FIG. 2.

FIG. 2 is a block diagram further illustrating in one example the timing controller 100 of FIG. 1. FIG. 3 is a related set of conceptual diagrams illustrating the operation of the timing controller 100 according to an embodiment of the inventive concept, and FIG. 4 is a conceptual diagram illustrating the flow of image data through the memory 120 of the timing controller 100 shown in FIG. 2.

Referring to FIGS. 1 and 2, the timing controller 100 may include the memory 120 as well as selection control logic unit 110.

The memory 120 may be used to temporarily store externally provided image data DATA1 in units of frames or in units of a plurality of lines, and thereafter to communicate the externally provided image data DATA1 to the source driver 300. Alternately, reformatted (e.g., image data internally generated by the timing controller 100 in response to the externally provided data DATA1) image data DATA2 may be provided to the source driver 300. The memory 120 may be graphic random access memory (graphic RAM) configured to store display data in frame units or a line buffer configured to store display data in line units. The memory 120 may include a volatile memory device, such as dynamic RAM (DRAM) and static RAM (SRAM), and/or a non-volatile memory device, such as a flash memory. The memory 120 may include DRAM, phase-change RAM (PRAM), magnetic RAM (MRAM), resistive RAM (ReRAM), ferromagnetic RAM (FRAM), a NOR flash memory, a NAND flash memory, or a fusion flash memory (e.g., a memory in which an SRAM buffer, a NAND flash memory, and a NOR interface logic unit are combined).

The selection control logic unit 110 may be used as described above to determine a driving order for the gate lines G1 to Gn of the display panel 10 in response to a pattern of the image data DATA1. In this respect, the selection control logic unit 110 will generate the selection control signal SHFL indicating an appropriate driving order. This operation will be described in some additional detail with reference to FIG. 3.

Referring to FIG. 3, one frame of the image data DATA1 may include image data corresponding to the gate lines G1 to Gn, that is, line data D1 to Dn. The line data D1 to Dn may include pixel data PD11 to PD1*m*, PD21 to PD2*m*, . . . , and PDn1 to PDnm corresponding to the source lines S1 to Sm, respectively. The image data DATA1 may be stored in the memory 120 in a frame unit or in a plurality of frame units.

The selection control logic unit 110 may be used to compare image data portions respectively corresponding to the gate lines in order to determine a driving order for the gate lines. In some embodiments, the selection control logic unit 110 may read image data corresponding to the gate lines G1 to Gn, that is, the line data D1 to Dn, from the memory 120 and compare data differences between the line data D1 to Dn. For example, the selection control logic unit 110 may compare first line data D1 corresponding to a first gate line G1 with second through fourth line data D2, D3, and D4 corresponding to second through fourth gate lines G2, G3, and G4 to calculate first, second and third comparison values Diff1, Diff2, and Diff3.

The selection control logic unit 110 may determine the driving order for the second, third and through fourth gate lines G2, G3, and G4 based on the first, second and third comparison values Diff1, Diff2, and Diff3. For example, the selection control logic unit 110 may determine a driving order for the second, third and fourth gate lines G2, G3, and G4 according to an ascending order of comparison values (i.e., an order starting from the smallest comparison value). When the second comparison value Diff2 is smallest and the third comparison value Diff3 is greatest, the selection control logic unit 110 may determine a driving order of; the third gate line G3, then the second gate line G2, and then the fourth gate line G4 being selected after the first gate line G1 is selected.

In some embodiments, when at least two comparison values are equal to each other, the selection control logic unit 110 may determine the driving order such one of the gate lines physically adjacent to a comparison reference gate line (e.g., the first gate line G1) selected from gate lines corresponding to the at least two comparison values is selected first.

The selection control logic unit 110 may provide the selection control signal SHFL indicating the driving order to the gate driver 200, such that the gate driver 200 selects from among the plurality of the gate lines G1 to Gn according to the determined driving order.

The determination of a driving order may be performed in a plurality of gate line units. For example, as shown in FIG. 3, the driving order for a first group of gate lines G2, G3, and G4 may be determined, and then the driving order for a second group of gate lines G5, G6, and G7 may be determined. In the case of determining the driving order for the second group of gate lines G5, G6, and G7, the selection control logic unit 110 may compare line data D5, D6, and D7 corresponding to the second group of gate lines G5, G6, and G7 with line data Dk corresponding to a gate line finally selected from among the first group of gate lines G2, G3, and G4, and determine the driving order for the second group of gate lines G5, G6, and G7 based on a comparison value.

As another example, a plurality of reference gate lines may be determined in advance, and the driving order for a plurality of gate lines selected after the plurality of reference gate lines may be set according to data comparisons with the plurality of reference gate lines. For example, the driving order for the first and fifth gate lines G1 and G5 may be set in advance so that the first gate line G1 and the fifth gate line G5 are selected first and fifth, respectively. The order of selection for the second through fourth gate lines G2, G3, and G4 may be set through data comparison with the first gate line G1, and the order of selection for sixth through eighth gate lines G6, G7, and G8 may be set through data comparison with the fifth gate line G5.

In this manner, a process of determining a driving order for gate lines organized according to in group units may be repeated, and thus, a complete driving order for all of the gate lines G1 to Gn may be determined.

In FIG. 2, although the driving order for the gate lines is determined in three-gate line units, this is only an example and the inventive concept is not limited thereto. The driving order for any collection of gate lines may be determined according to rationally designated groups, wherein each group includes at least two gate lines.

In addition, although the line data D1 to Dn corresponding to the gate lines G1 to Gn are compared with each other to calculate comparison values, the inventive concept is not limited thereto. In some other embodiments, only some pixel data included in the line data D1 to Dn may be compared with each other. For example, first and m-th pixel data PD11 and PD1*m* of the first gate line G1 may be compared with first and m-th pixel data PD21 and PD2*m*, PD31 and PD3*m*, and PD41 and PD4*m* of the second through fourth gate lines G2, G3, and G4, respectively, to calculate comparison values Diff1, Diff2, and Diff3. In some other embodiments, each of first through m-th pixel data may include a plurality of bits, and some upper bits of a plurality of bits of pixel data of a gate line may be compared with some upper bits of a plurality of bits of another gate line to calculate the comparison values Diff1, Diff2, and Diff3. In still other embodiments, all of a plurality of bits of pixel data of a gate line may be compared with all of a plurality of bits of another gate line to calculate the comparison values Diff1, Diff2, and Diff3.

The selection control logic unit 110 may determine the driving order for gate lines G1 to Gn depending on the comparison values Diff1, Diff2, and Diff3. As shown in FIG. 3, the gate lines G1 to Gn may be sequentially or non-sequentially selected with respect their ordered arrangement. In a default gate line selection mode, the gate lines G1 to Gn may be sequentially selected with respect to their ordered arrangement. However, in shuffle gate line mode, the gate lines G1 to Gn may be non-sequentially selected with respect to their ordered arrangement, depending on the comparison values Diff1, Diff2, and Diff3.

Referring back to FIG. 2, the selection control logic unit 110 may also be used to change an image data storing order with respect to line data D1 to Dn stored in the memory 120 or an image data outputting order with respect to the line data output from the memory 120 to the source driver 300 of FIG. 1 consistent with the driving order for the gate lines G1 to Gn.

Referring to FIG. 4, the externally provided image data DATA1 may be stored in the memory 120 according to a data reception order, as arranged (e.g.,) in line units. The externally provided image data DATA1 may be communicated to the source driver 300 of FIG. 1 in line units (e.g., in units of line data D1 to Dn) according to the order in which the externally provided image data DATA1 is stored in the memory 120. However, as described with reference to FIG. 3, when a driving order for the gate lines G1 to Gn is varied, the image data outputting order for the line data D1 to Dn—correspondingly output to the source driver 300—will also be varied. As shown in FIG. 4, the selection control logic unit 110 may change the image data storing order for the line data D1 to Dn to correspond to the driving order for the gate lines G1 to Gn. After the image data storing order is varied, a first address ADDR1 through an n-th address ADDRn may be sequentially accessed. Accordingly, the line data D1 to Dm may be output to the source driver 300 in accordance with the driving order for the gate lines G1 to Gn.

In some other embodiments, the selection control logic unit 110 may vary the image data outputting order for the line data D1 to Dn stored in the memory 120 in accordance with the driving order for the gate lines G1 to Gn. The line data D1 to Dn, i.e., first through n-th line data D1 to Dn, may be stored in the first through n-th addresses ADDR1 to ADDRn, and the selection control logic unit 110 may control the memory 120 to access the first through n-th addresses ADDR1 to ADDRn based on the driving order for the gate lines G1 to Gn. For example, the selection control logic unit 110 may access the first address ADDR1 so that the first line data D1 is output to the source driver 200, and then may access the third address ADDR3 so that the third line data D3 is output to the source driver 300. Accordingly, the line data D1 to Dn, i.e., the first through n-th line data D1 to Dn, may be output to the source driver 300 depending on the driving order for the gate lines G1 to Gn.

In some embodiments, the selection control logic unit 110 may be selectively operated according to different modes. For example, an operating state of the selection control logic unit 110 may be determined according to a user-defined selection. For example, the user may block operation of the selection control logic 110 or otherwise control the selection control logic unit 110 so that the gate lines G1 to Gn are selected in only a sequential driving order (e.g., the gate line selection default mode.

In some other embodiment, the selection control logic unit 110 may be operative when the externally provided image data DATA1 is still image, and be non-operative when the externally provided image data DATA1 is moving image. In this regard, an image mode signal IMODE may be used to indicate image data type or source. In some embodiments, the image mode signal IMODE will be externally generated and provided, together with the externally provided image data DATA1. In some other embodiments, the timing controller 100 may analyze the received image data DATA1 and internally generate the image mode signal IMODE.

Where the externally provided image data is moving image data, data differences between adjacent gate lines may be smaller than data differences between non-adjacent gate lines. Accordingly, when the externally provided image data DATA1 is moving image data, the operation of the selection control logic unit 110 may be blocked and the gate lines G1 to Gn may be sequentially selected depending on their ordered arrangement. On the contrary, when the externally provided image data DATA1 is a still image, data differences between adjacent gate lines may be larger than data differences between non-adjacent gate lines, depending upon the particular image data pattern. For example, in case of an image including a horizontal black/white stripe pattern, a data difference between adjacent gates lines may have a maximum value. Accordingly, the selection control logic unit 110 may perform a gate line selection control operation when the externally provided image data DATA1 is still image data.

In some embodiments, when a still image is displayed on the display panel 10 of FIG. 1 during a plurality of frame periods, the selection control logic unit 110 may perform a calculation operation for a comparison of the image data DATA1 in a first frame period of the plurality of frame periods, and may not perform the calculation operation in other frame periods. The selection control signal SHFL generated in the first frame period may be used in other frame periods. Accordingly, the amount of calculation of the selection control logic unit 110, which is used for a data comparison, may be reduced.

Figure 5:
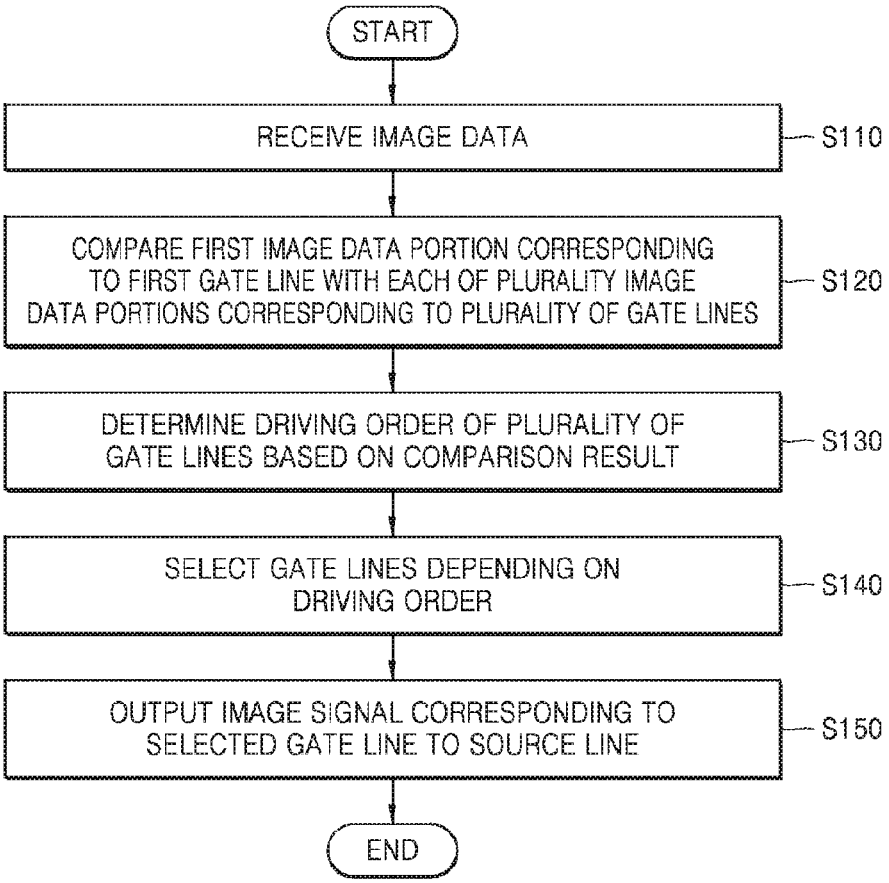
FIG. 5 is a flowchart illustrating an operating method of a display device, according to an exemplary embodiment.

FIG. 5 is a flowchart illustrating an operating method of the display device 1000 according to certain embodiments of the inventive concept.

The operating method of the display device 1000 is a method of setting a driving order (or an order of selection) for the gate lines G1 to Gn, and thereby driving the display panel 10 in accordance with the set driving order. Reference is made here to the subject matter previously described in relation to FIGS. 1, 2, 3 and 4.

Referring to FIG. 5, the display device 1000 receives image data (S110). The image data may be received from the outside (e.g., a host processor). The image data may be stored in a memory (e.g., the memory 120 of FIG. 2) included in the timing controller 100 or a memory that is provided independently of the timing controller 100.

The timing controller 100 then compares image data portions corresponding to a plurality of gate lines adjacent to the reference gate line with an image data portion (hereinafter, referred to as a "reference image data portion") associated with the reference gate line (S120). For example, the reference gate line may be a first gate line of the display panel 10 or one of a plurality of gate lines having a driving order partially selected in advance. As another example, if a comparison of image data portions corresponding to a plurality of gate lines is performed in group units, the reference gate line may be a gate line set to be finally selected in a particular group before a current group of gate lines having its driving order determined.

The timing controller 100 may determine the driving order for the plurality of gate lines based on respective comparison value(s) (S130). The timing controller 100 may generate a selection control signal indicating the driving order and provide the selection control signal to the gate driver 200.

The gate driver 200 may then select from among the plurality of gate lines in response to the driving order as indicated by the selection control signal (S140). The source driver 300 may output an image signal (i.e., a gradation voltage) corresponding to a selected gate line to a source line (S150).

Figure 6:
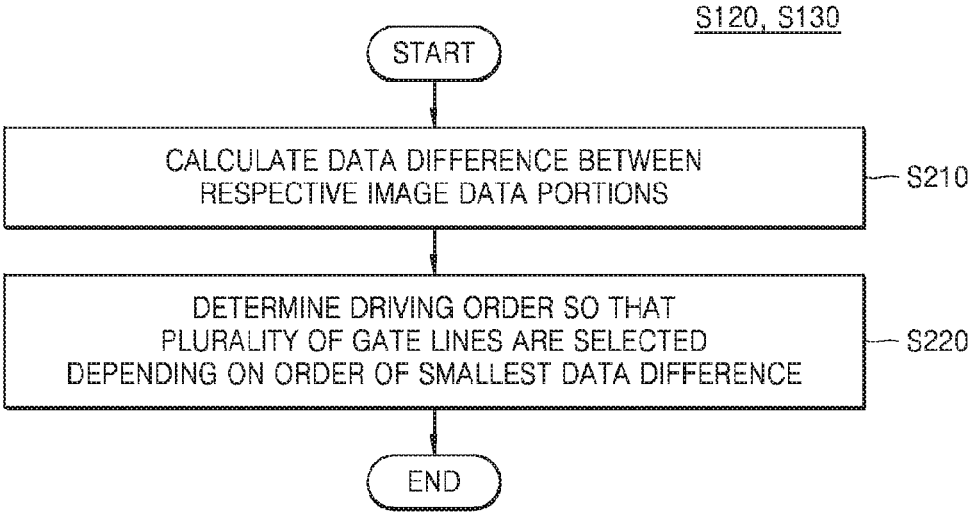
FIG. 6 is a flowchart illustrating an exemplary embodiment of comparing the image data and determining an order of selection, shown in the flowchart of FIG. 5.

FIG. 6 is a flowchart further illustrating in one example the comparison step (S120) and the driving order determining step (S130) included in the method of FIG. 5 according to an embodiment of the inventive concept. Referring to FIG. 6, the timing controller 100 may be used to calculate respective data differences between image data portions associated with gate lines and a reference image data portion (S210). For example, assuming the use of N image data portions respectively corresponding to N gate lines, where 'N' is a positive integer greater than 1, N comparisons are same are respectively made in relation to a reference image data portions in order to calculi N respective data differences.

The timing controller 100 may then be used to determine a driving order (or order of gate line selection) for a plurality of gate lines, wherein the driving order is consistent with an ascending order of data differences (i.e., an order starting from the smallest data difference) (S220). If comparison values corresponding to at least two gate lines are equal to each other, the timing controller 100 may control the order of selection so that a gate line physically adjacent to a reference gate line from among the at least two gate line is selected first.

Figure 7:
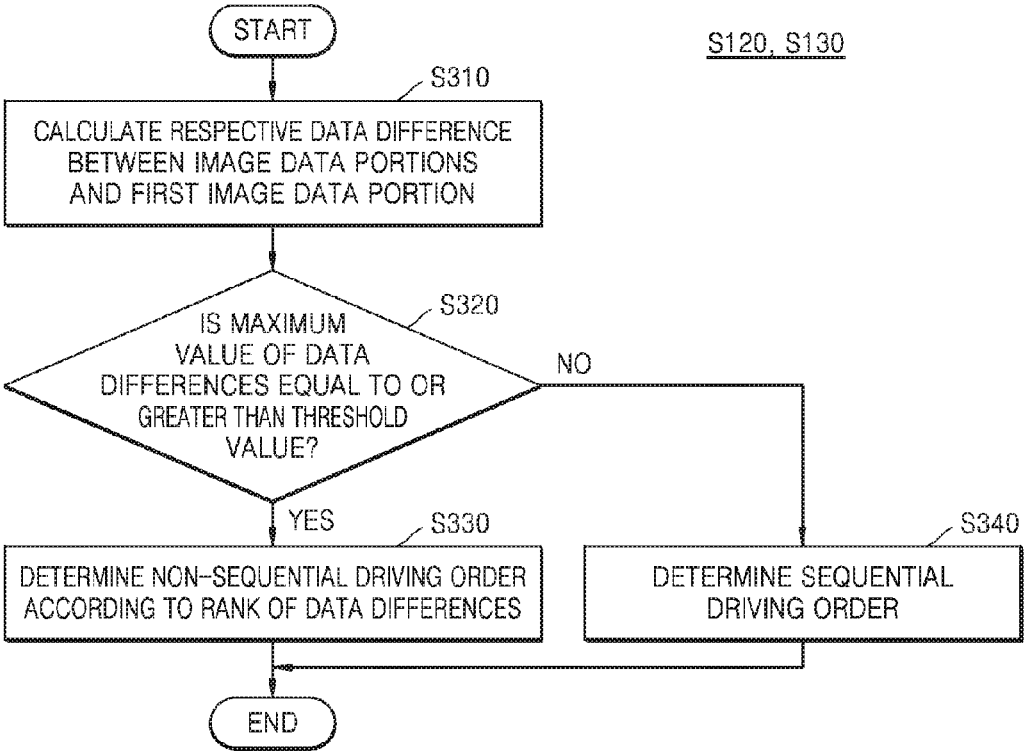
FIG. 7 is a flowchart illustrating another exemplary embodiment of the comparing of the image data and the determining of the order of selection, shown in the flowchart of FIG. 5.

FIG. 7 is a flowchart further illustrating in one example the comparing step (S120) and the driving order determining step (S130) included in the method of claim 5 according to embodiment of the inventive concept.

Referring to FIG. 7, the timing controller 100 may be used to calculate respective data differences between image data portions associated with gate lines and a reference image data portion (S310). Accordingly, a corresponding plurality of data differences may be calculated.

Then, the timing controller 100 may determine whether a greatest data difference among the plurality of data differences is equal to or greater than a predetermined threshold value (S320). If so (S320=YES), then the timing controller 100 will set a non-sequential driving order for the plurality of gate lines according to an ascending order of the plurality of data differences (S330). If not so (S320=NO), the timing controller 100 will set a sequential driving order for the plurality of gate lines consistent with their ordered arrangement and regardless of the calculated plurality of data differences (S340).

Figure 8:
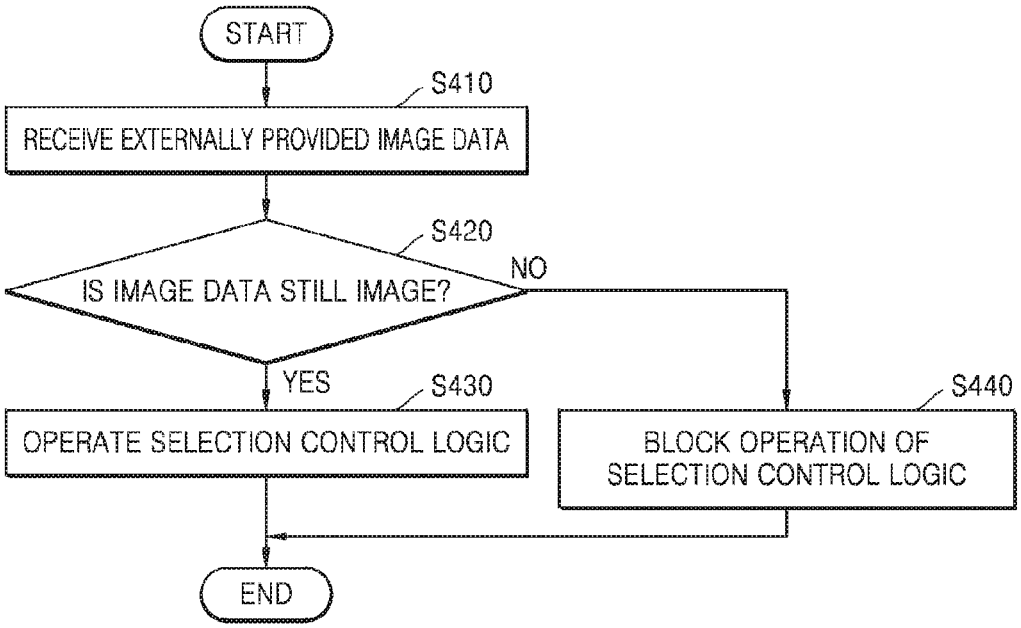
FIG. 8 is a flowchart illustrating an operation of a timing controller according to an exemplary embodiment.

FIG. 8 is a flowchart illustrating an operation of the timing controller 100 according to an embodiment of the inventive concept.

Referring to FIG. 8, the timing controller 100 receives externally provided image data (S410). Then, the timing controller 100 determine whether or not the image data is still image data (S420). For example, the timing controller 100 may receive a signal indicating a type (or source) of the externally provided image data. Such a signal may be externally provided or internally generated by the timing controller 100. For example, the externally provided image data may be determined to be still image data or moving image data by comparing image data between frames.

When the image data is determined to be still image data (S420=YES), the timing controller 100 operates using the selection control logic unit 110 (S430), and the selection control logic 110 may compare various image data portions associated with gate line or gate line groups to set a driving order for the gate lines. However, when the externally provided image data is determined to be moving image data (S420=NO), the timing controller 100 blocks operation of the selection control logic unit 110, and sets a sequential driving order for the gate lines.

Figure 9A:
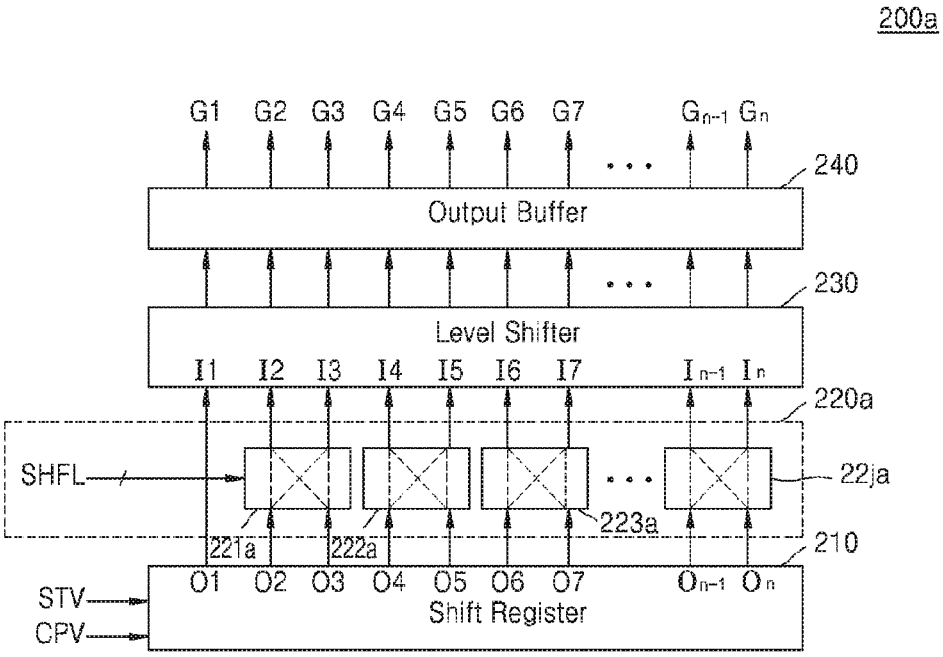
FIGS. 9A, 9B and 9C are block diagrams illustrating implementation examples of a gate driver of FIG. 1.
Figure 9B:
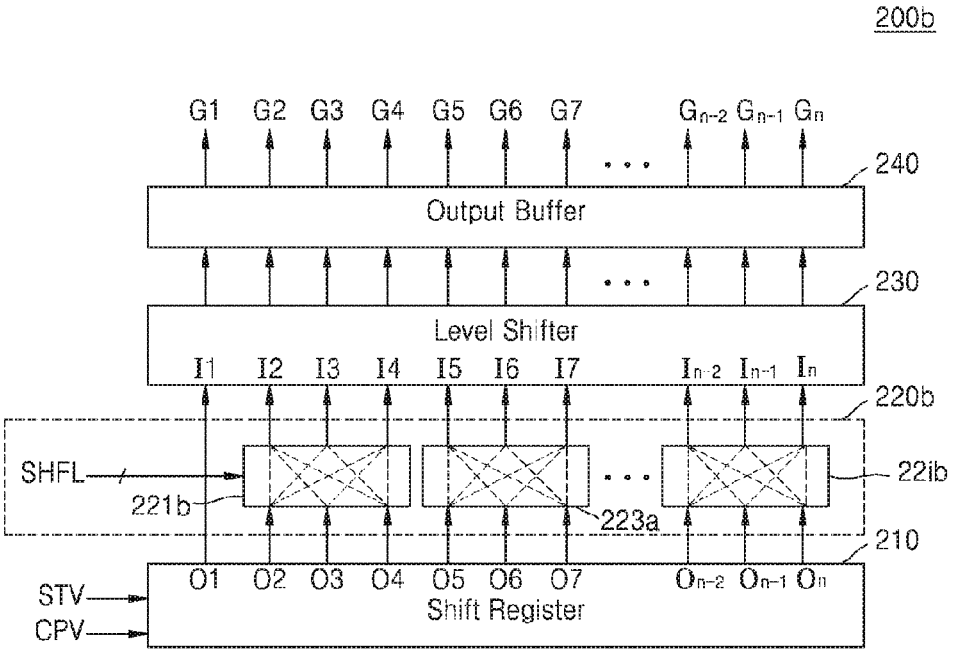
Figure 9C:
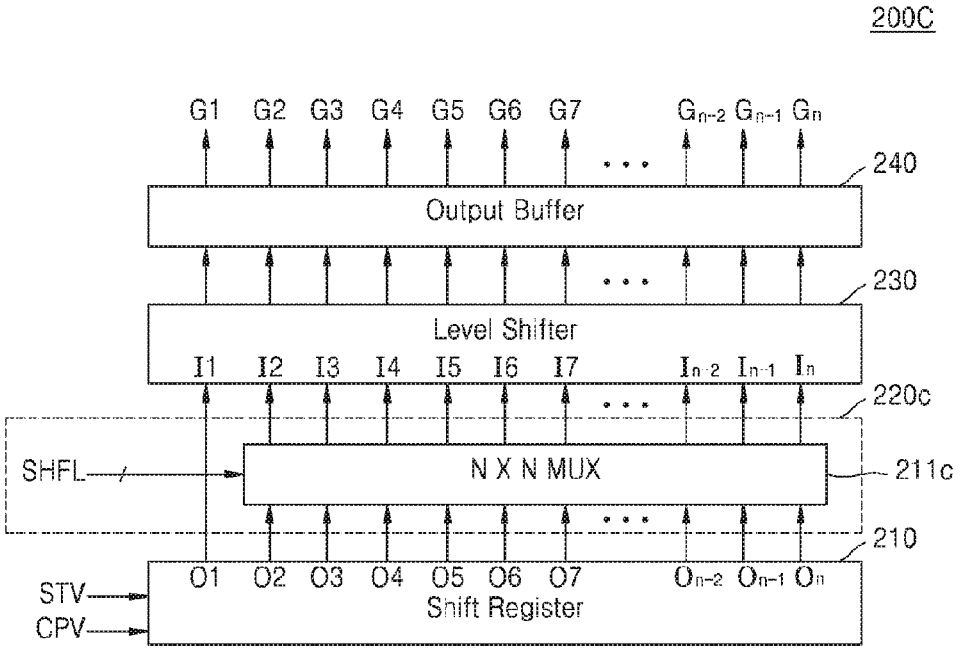

FIGS. 9A, 9B and 9C are block diagrams variously illustrating implementation examples for the gate driver 200 of FIG. 1.

Referring to FIG. 9A, a gate driver 200*a* may include a shift register 210, a multiplexer 220*a*, a level shifter 230, and an output buffer 240.

The shift register 210 may sequentially generate a plurality of shift pulses based on a vertical start signal STV and a gate clock signal CPV. The number of shift pulses that are generated by the shift register 210 may be equal to that of gate lines G1 to Gn. The plurality of shift pulses may be sequentially output from a plurality of output terminals O1 to On of the shift register 210.

The level shifter 230 may shift a voltage level of an applied shift pulse. The output buffer 240 may generate a plurality of scan pulses based on a level-shifted shift pulse output from the level shifter 230 and supply the plurality of scan pulses to the gate lines G1 to Gn.

The multiplexer 220*a* may set a connection relation between a plurality of outputs of the shift register 210 and a plurality of inputs of the level shifter 230, in response to the selection control signal SHFL. In some embodiments, the multiplexer 220*a* may include a plurality of multiplexers 221*a* to 22*ja*. The plurality of multiplexers 221*a* to 22*ja* may set a connection relation between N outputs of the shift register 210 and N inputs of the level shifter 230, in response to the selection control signal SHFL.

As illustrated in FIG. 9A, each of the plurality of multiplexers 221*a* to 22*ja* may be a 2×2 multiplexer that is connected to two outputs of the shift register 210 and two inputs of the level shifter 230. A connection between an input of each multiplexer 221*a* to 22*ja* and an output thereof may be changed in response to the selection control signal SHFL. The selection control signal SHFL may be one bit data and have a low level or a high level.

Since the multiplexer 220*a* includes the plurality of multiplexers 221*a* to 221*ja*, the selection control signal SHFL may include first through j-th selection control signals SHFL1 to SHFLj corresponding to the plurality of multiplexer 221*a*~22*ja*, respectively, and the first through j-th selection control signals SHFL1 to SHFLj may be received through a time-sharing method, and then be provided to the plurality of multiplexer 221*a*~22*ja*.

In this manner, as the multiplexer 220*a* controls a connection relation between a plurality of outputs of the shift register 210 and a plurality of inputs of the level shifter 230, in response to the selection control signal SHFL, the gate lines G1 to Gn may be selected depending on a set order.

As illustrated in FIG. 9B, a multiplexer 220*b* corresponding to the multiplexer 220*a* may include a plurality of 3×3 multiplexers 221*b* to 22*ib*. In addition, as illustrated in FIG. 9C, a multiplexer 220*c* corresponding to the multiplexer 220*a* may include an (N×N) multiplexer.

Referring to FIG. 9B, each of the plurality of multiplexers 221*b* to 22*ib* may be connected to three outputs of the shift register 210 and three inputs of the level shifter 230 and control a connection relation between the three outputs of the shift register 210 and the three inputs of the level shifter 230. In this case, the selection control signal SHFL may be data including a plurality of bits, and a connection between the inputs of the multiplexers 221*b* to 22*ib* and the outputs of the multiplexers 221*b* to 22*i* may be changed according to data values of the selection control signal SHFL.

Referring to FIG. 9C, the multiplexer 230*c* may include one (N×N) multiplexer. In this case, where 'N' is an integer greater than 2 and less than n, where 'n' is a number of gate lines G1 to Gn.

Although not illustrated in FIGS. 9A, 9B and 9C, each of the multiplexers 220*a*, multiplexer 220*b*, and 220*c* may include different kinds of multiplexers having different numbers of inputs and different numbers of outputs.

The configurations and operations of the gate drivers 200*a*, 200*b*, and 200*c* have been described above with reference to FIGS. 9A, 9B and 9C, but are not limited thereto. The configurations and operations of the gate drivers 200*a*, 200*b*, and 200*c* may be variously changed with reference to FIGS. 9A, 9B and 9C.

Figure 10:
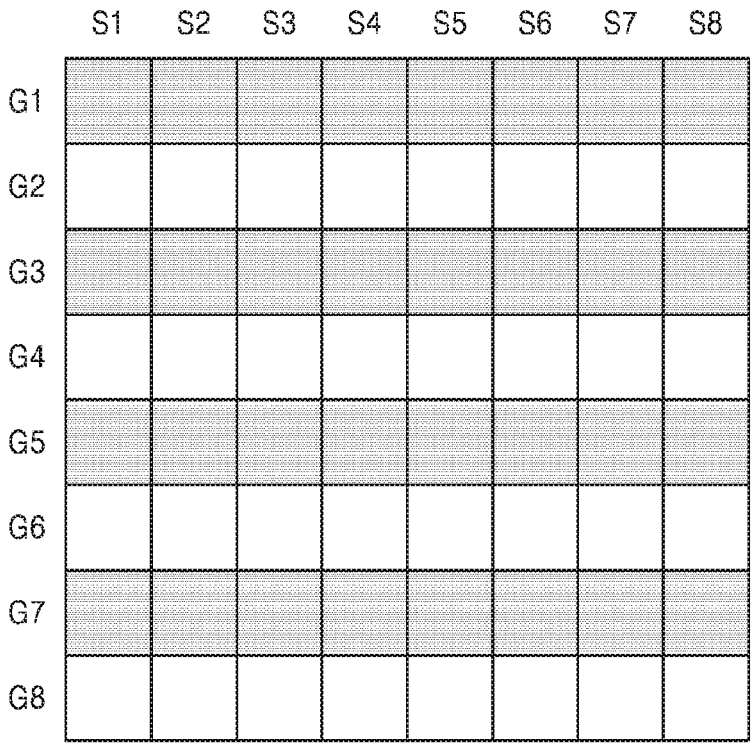
FIG. 10 illustrates a black and white stripe pattern.
Figure 11A:
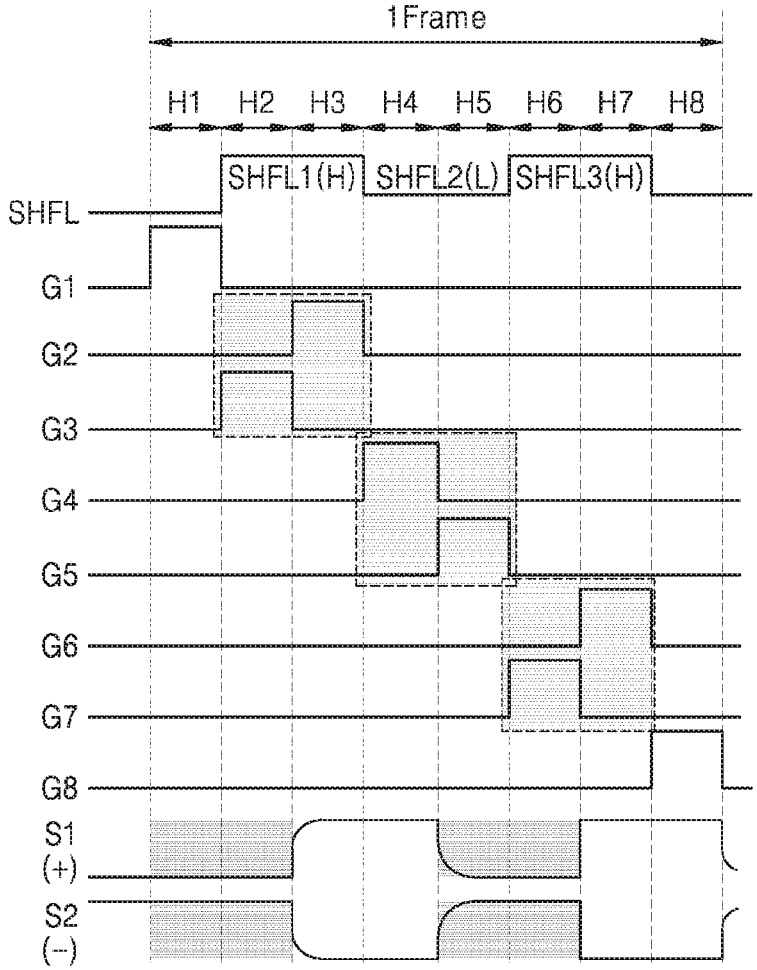
FIGS. 11A, 11B and 11C each illustrate waveforms of signals when the display device of FIG. 1 displays an image pattern of FIG. 10.
Figure 11B:
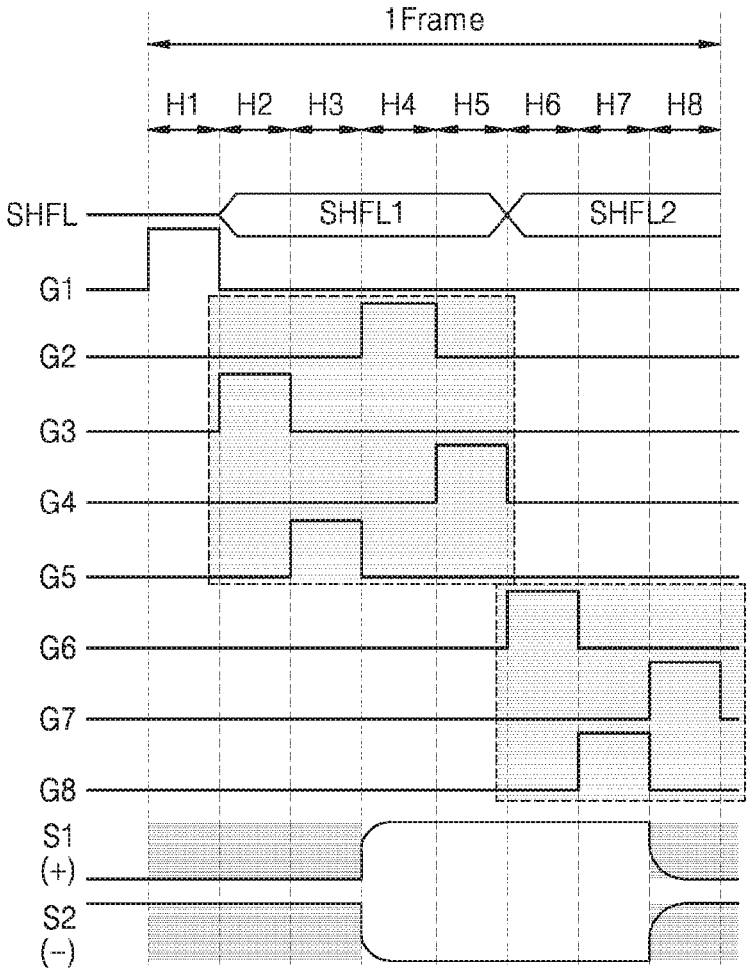
Figure 11C:
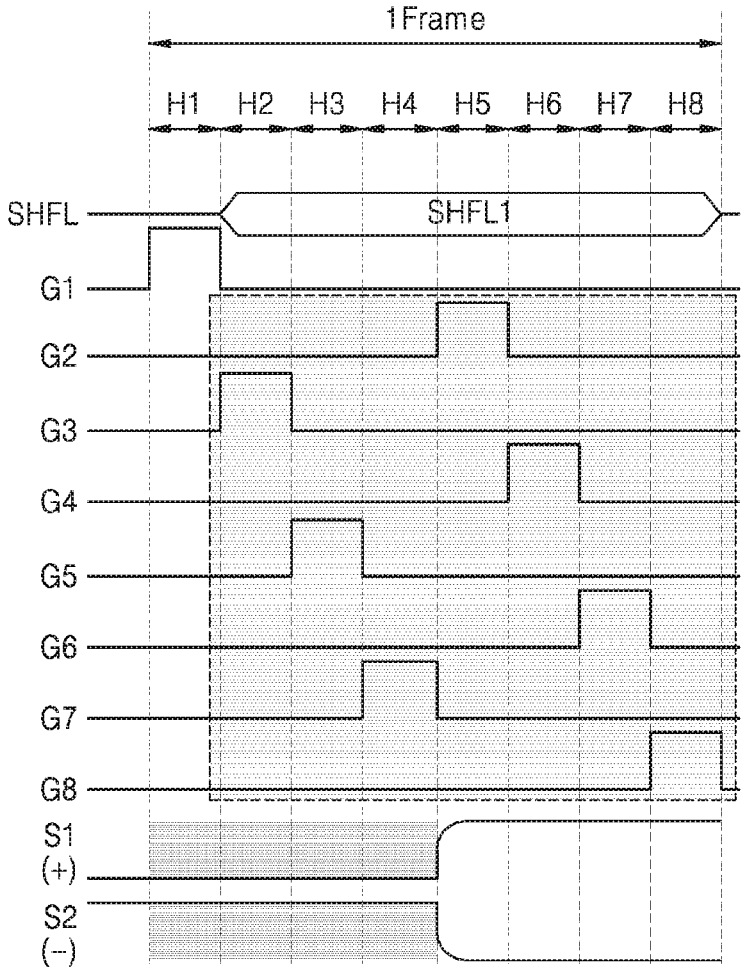

FIGS. 10, 11A, 11B and 11C are diagrams describing in some additional detail an operating method of the display device 1000 of FIG. 1 according to embodiments of the inventive concept. FIG. 10 illustrates a black and white stripe pattern. FIGS. 11A, 11B and 11C each illustrate waveforms of signals when the display device 1000 displays an image pattern (i.e., the black and white stripe pattern) of FIG. 10.

For brevity, it is assumed that the display panel 10 includes pixels arranged in 8 rows and 8 columns. In addition, it is assumed that the display panel 10 is column-inverted, a positive signal is applied to odd source lines, and a negative signal is applied to even source lines. In this case, the positive signal means a gradation voltage having a voltage level that is higher than that of the common voltage Vcom equally applied to the pixels PX, and the negative signal means a gradation voltage having a voltage level that is lower than that of the common voltage Vcom.

Referring to FIG. 10, back images and white images are alternately repeated in gate line units. In the case of a pattern in which black images and white images are alternately repeated, the output of the source driver 300 may transition between a minimum gradation voltage and a maximum gradation voltage. In other words, the output of the source driver 300 may swing with maximum amplitude.

When gate lines are sequentially selected and driven depending on the order of arrangement, the output of the source driver 300 may transition eight times. Referring to Equation 1, a dynamic power of the output buffer 301 of FIG. 1 included in the source driver 300 may be represented by Equation 2:

$$P = \frac{1}{2} \cdot C_{Load} \cdot V_{Supply} \cdot V_{Swing} \cdot (1 \cdot f_{1H}) \tag{2}$$

Since the output of the output buffer 301 swings with maximum amplitude for each and every gate line, transition probability may be 1 and an output of the dynamic power may be maximized.

Referring to FIG. 11A, the driving order for the first through eighth gate lines G1 to G8 may be changed in two gate line units in response to the selection control signal SHFL consisting of one bit. Referring to FIG. 10, odd gate lines G1, G3, G5, and G7 correspond to a black image, and even gate lines G2, G4, G6, and G8 correspond to a white image. After the first gate line G1 is selected, the third gate line G3 having the same image data as the first gate line G1 from among the second gate line G2 and the third gate line G3 may be selected first. In the second horizontal line period H2, a change of an image signal does not occur at source lines S1 and S2. As the second gate line G2 corresponding to the white image is selected after the second horizontal line period H2, a change of an image signal occurs at the source lines S1 and S2. Accordingly, the output of the source driver 300 of FIG. 1 transitions.

As the driving order for the first through eighth gate lines G1 to G8 is set in two gate line units, the black image and the white image are alternately displayed in two horizontal line units, and thus, the output of the source driver 300 may transition four times. Accordingly, the transition probability may be 0.5, and thus, the dynamic power of the output buffer 301 included in the source driver 300 may be half a maximum value.

Referring to FIG. 11B, the driving order for the first through eighth gate lines G1 to G8 may be changed in four gate line units in response to the selection control signal SHFL consisting of a plurality of bits. After the first gate line G1 is selected, the third and fifth gate lines G3 and G5 each having the same image data as the first gate line G1 from among the second through fifth gate lines G2 to G5 may be selected first. In the second horizontal line period H2 and the third horizontal line period H3, a change of an image signal does not occur at the source lines S1 and S2. As the second and fourth gate lines G2 and G4 corresponding to the white image are selected after the second and third horizontal line periods H2 and H3, a change of an image signal occurs at the source lines S1 and S2. Accordingly, the output of the source driver 300 transitions.

As the driving order for the first through eighth gate lines G1 to G8 is set in four gate line units, the output of the source driver 300 may transition two times. Accordingly, the transition probability may be 0.25, and thus, the dynamic power of the output buffer 301 included in the source driver 300 may be ¼ of the maximum value.

Referring to FIG. 11C, the driving order for the first through eighth gate lines G1 to G8 may be changed all together in response to the selection control signal SHFL consisting of a plurality of bits. After the first gate line G1 is selected, the third, fifth, and seventh gate lines G3, G5, and G7 each having the same image data as the first gate line G1 from among the second through eighth gate lines G2 to G8 may be selected first. In the second through fourth horizontal line periods H2, H3, and H4, a change of an image signal does not occur at the source lines S1 and S2. As the second gate line G2 corresponding to the white image is selected after the second through fourth horizontal line periods H2, H3, and H4, a change of an image signal occurs at the source lines S1 and S2 in the fifth horizontal line period H5. Accordingly, the output of the source driver 300 transitions.

As the driving order for the first through eighth gate lines G1 to G8 is set in eight gate line units, the output of the source driver 300 may transition one time. Accordingly, the transition probability may be 0.125, and thus, the dynamic power of the output buffer 301 included in the source driver 300 may be ⅛ of a maximum value.

Figure 12A:
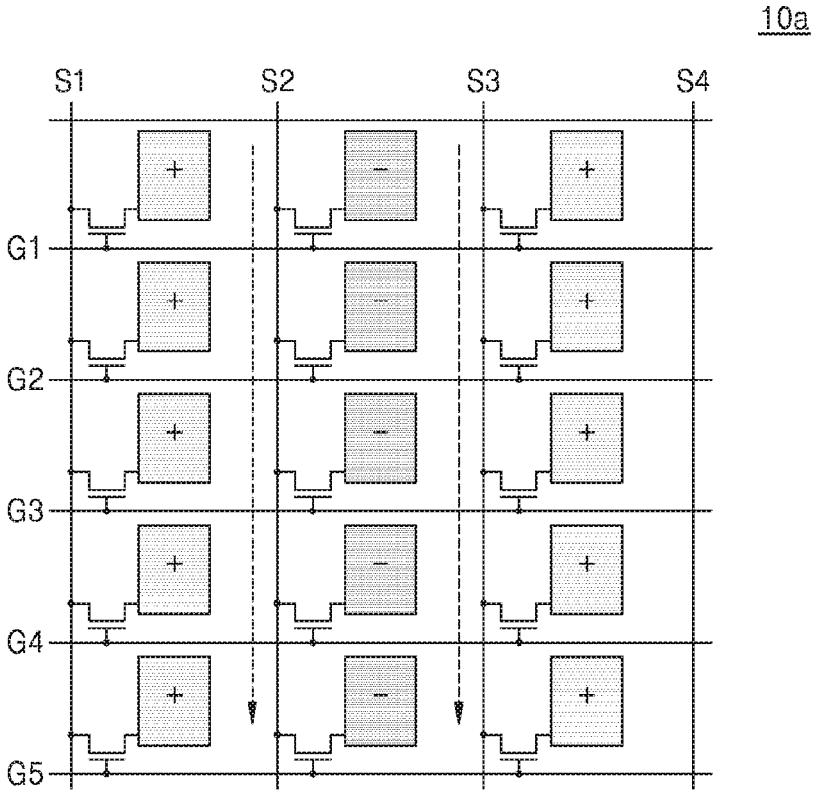
FIGS. 12A and 12B are diagrams illustrating embodiments of a display panel of FIG. 1.
Figure 12B:
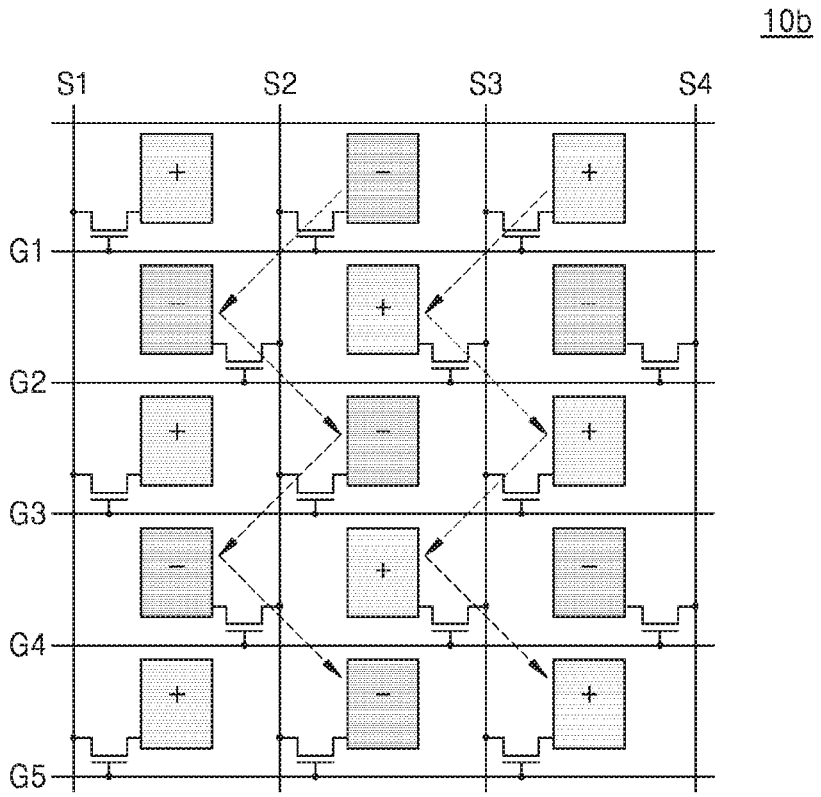

FIGS. 12A and 12B are diagrams illustrating possible embodiments for the display panel 10 of FIG. 1. FIG. 12A illustrates a straight type of panel, and FIG. 12B illustrates a zig-zag type of panel.

Referring to FIG. 12A, a display panel 10*a* may be a straight type of panel in which a plurality of pixels PX arranged in the same column are connected to the same source line. If the display panel 10*a* is driven in a column inversion method, a positive signal may be applied to odd source lines S1 and S3 and a negative signal may be applied to even source lines S2 and S4.

Referring to FIG. 12B, a display panel 10*b* may be a zig-zag type of panel in which a plurality of pixels PX arranged in the same column are connected to one of two source lines arranged at both sides of the pixels PX. Accordingly, even if the polarity of a signal output from the source drive 300 of FIG. 1 is not changed, the display panel 10*b* may be driven in a dot inversion method.

Figure 13:
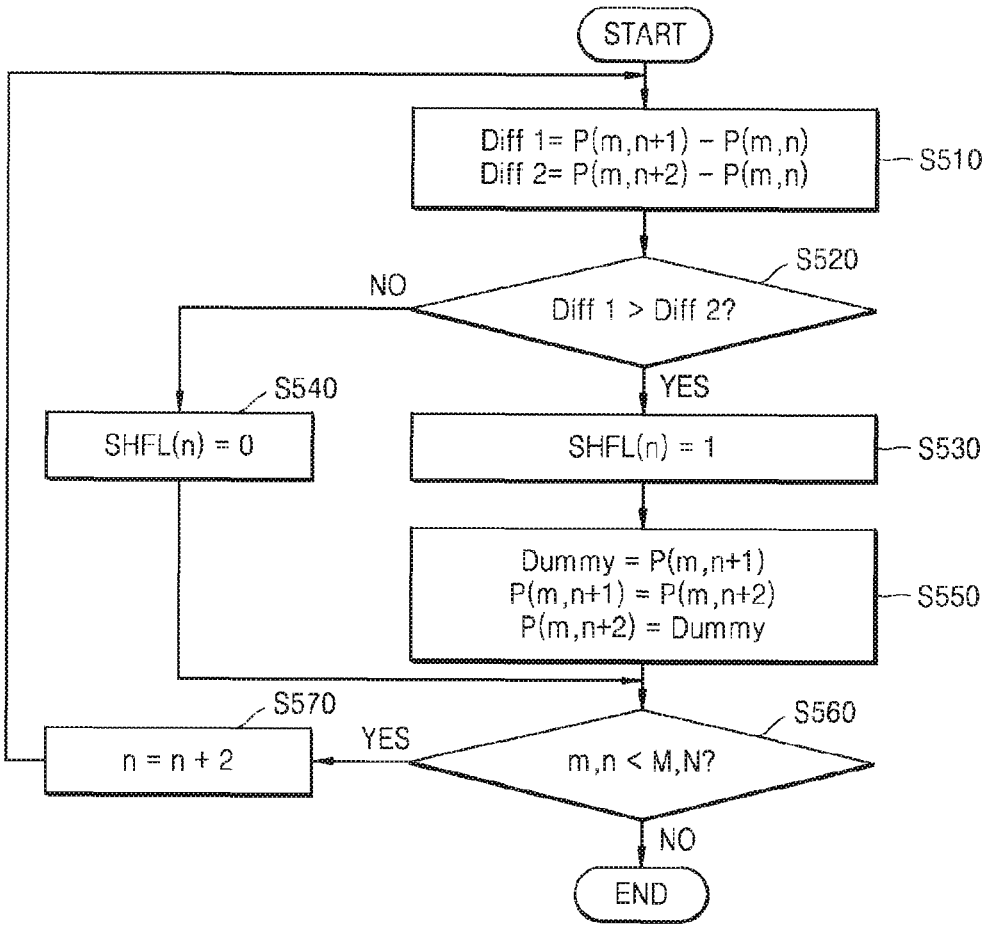
FIG. 13 is a flowchart illustrating an operating method of a timing controller when a display panel is a straight type panel, according to an exemplary embodiment.

FIG. 13 is a flowchart illustrating an operating method for a timing controller when the display panel 10*a* is a straight type of panel according to an exemplary embodiment.

Referring to FIG. 13, the driving order for gate lines may be controlled in two gate line units, and a plurality of pieces of data may be compared with each other in pixel units.

P(m, n) is pixel data stored in a memory cell arranged in an n-th row and an m-th column in a memory (e.g., the memory 120 of FIG. 12). Initially (e.g., before a rearrangement of pixel data is performed by setting the driving order for the gate lines), P(m, n) denotes pixel data indicating an m-th pixel of an n-th gate line.

A number of pixel data portions associated with adjacent gate lines are compared with each other to calculate respective comparison value(s) (S510). A data difference between P(m, n+1) and P(m, n) may be calculated as a first comparison value Diff1, and a data difference between P(m, n+2) and P(m, n) may be calculated as a second comparison value Diff2.

It is determined whether the first comparison value Diff1 is greater than the second comparison value Diff2 (S520). If it is determined that the first comparison value Diff1 is greater than the second comparison value Diff2, a selection control signal SHFL(n) may be set to a second logic level (e.g., a logic high level) (S530). If it is determined that the first comparison value Diff1 is not greater than the second comparison value Diff2, the selection control signal SHFL (n) may be set to a first logic level (e.g., a logic low level) (S540). If the selection control signal SHFL(n) is set to the second logic level, the gate lines are non-sequentially driven, and thus, the order of storing of the plurality of pieces of pixel data may be changed to correspond to the driving order for the gate lines (S550). In some embodiments, P(m, n+1) may be stored in a dummy cell, and P(m, n+2) may be stored in a memory cell corresponding to P(m, n+1). Data stored in the dummy cell may stored in a memory cell corresponding to P(m, n+2) again, and thus, the plurality of pieces of pixel data may be rearranged.

It may be determined whether or not a driving order has been set with respect to all of the gate lines by comparing m and n with M and N, respectively, which indicate the resolution of a display panel, e.g., the display panel 10 of FIG. 1, where 'M' is the horizontal resolution of the display panel and 'N' is the vertical resolution of the display panel (S560). If m and n are smaller than M and N, respectively, it is determined that the setting of the order of selection for the gate lines is not completed, and thus, n is increased by 2 (S570) and operations S510 through S550 are appropriately performed with respect to an (n+2)-th row. The driving order for all of the gate lines may be set by repeating this type of process, and thus, pixel data may be rearranged in the memory 120.

Figure 14:
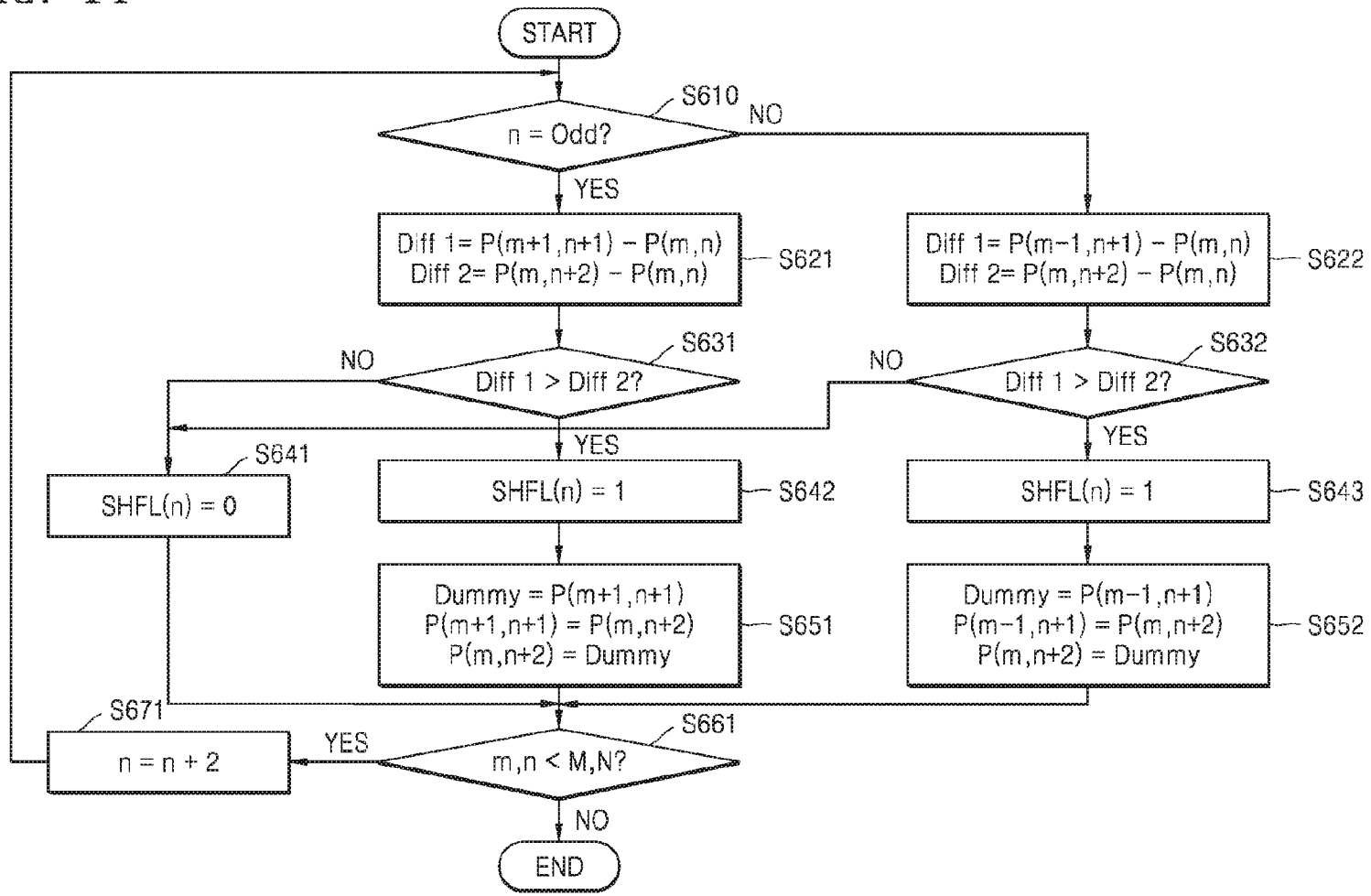
FIG. 14 is a flowchart illustrating an operating method of a timing controller when a display panel is a zig-zag type panel, according to an exemplary embodiment.

FIG. 14 is a flowchart illustrating an operating method for a timing controller when the display panel 10*a* is a zig-zag type of panel according to an exemplary embodiment of the inventive concept.

Referring to FIG. 14, the driving order for gate lines may be controlled in two gate line units, and a plurality of pixel data portions may be compared using (e.g.,) a defined pixel unit.

In the case of the zig-zag type of panel, a method of comparing pixel data varies according to whether P(m, n) is pixel data of an odd row or pixel data of an even row. Accordingly, it has to be determined whether an n-th row is an odd row or an even row (S610).

If it is determined that the n-th row is an odd row, a plurality of pieces of pixel data between adjacent gate lines are compared with each other to calculate a comparison value (S621). Specifically, if it is determined that the n-th row is an odd row, a data difference between P(m+1, n+1) and P(m, n) may be calculated as a first comparison value Diff1, and a data difference between P(m, n+2) and P(m, n) may be calculated as a second comparison value Diff2.

It is determined whether the first comparison value Diff1 is greater than the second comparison value Diff2 (S631). If it is determined that the first comparison value Diff1 is greater than the second comparison value Diff2, a selection control signal SHFL(n) may be set to a second logic level (e.g., a logic high level) (S642). If it is determined that the first comparison value Diff1 is not greater than the second comparison value Diff2, the selection control signal SHFL (n) may be set to a first logic level (e.g., a logic low level) (S641). If the selection control signal SHFL(n) is set to the second logic level, the gate lines are non-sequentially driven, and thus, the image data storing order for respective pixel data portions may be varied to correspond to the driving order for the gate lines (S651). In some embodiments, P(m+1, n+1) may be stored in a dummy cell, and P(m, n+2) may be stored in a memory cell corresponding to P(m+1, n+1). Data stored in the dummy cell may stored in a memory cell corresponding to P(m, n+2) again, and thus, the pixel data portions may be rearranged.

If it is determined that the n-th row is an even row, pixel data portions between adjacent gate lines are compared with each other to calculate a comparison value (S622). Specifically, it is determined that the n-th row is an even row, a data difference between P(m−1, n+1) and P(m, n) may be calculated as a first comparison value Diff1, and a data difference between P(m, n+2) and P(m, n) may be calculated as a second comparison value Diff2.

It is determined whether the first comparison value Diff1 is greater than the second comparison value Diff2 (S632). If it is determined that the first comparison value Diff1 is greater than the second comparison value Diff2, the selection control signal SHFL(n) may be set to a second logic level (e.g., a logic high level) (S643). If it is determined that the first comparison value Diff1 is not greater than the second comparison value Diff2, the selection control signal SHFL(n) may be set to a first logic level (e.g., a logic low level) (S641). If the selection control signal SHFL(n) is set to the second logic level, the gate lines are non-sequentially driven, and thus, the order of pixel data storing may be changed to correspond to the driving order for the gate lines (S652). In some embodiments, P(m−1, n+1) may be stored in a dummy cell, and P(m, n+2) may be stored in a memory cell corresponding to P(m+1, n+1). Data stored in the dummy cell may stored in a memory cell corresponding to P(m, n+2) again, and thus, the pixel data portions may be rearranged.

Next, it is determined whether the driving order for all of the gate lines has been determined (S661). If m and n are smaller than M and N, respectively, it is determined that the setting of the order of selection for the gate lines is not completed, and thus, n is increased by 2 (S671) and the operations S610 through S651 are performed with respect to an (n+2)-th row. The driving order for all of the gate lines may be set by repeating such a process, and thus, pixel data may be rearranged in the memory 120.

Figure 15:
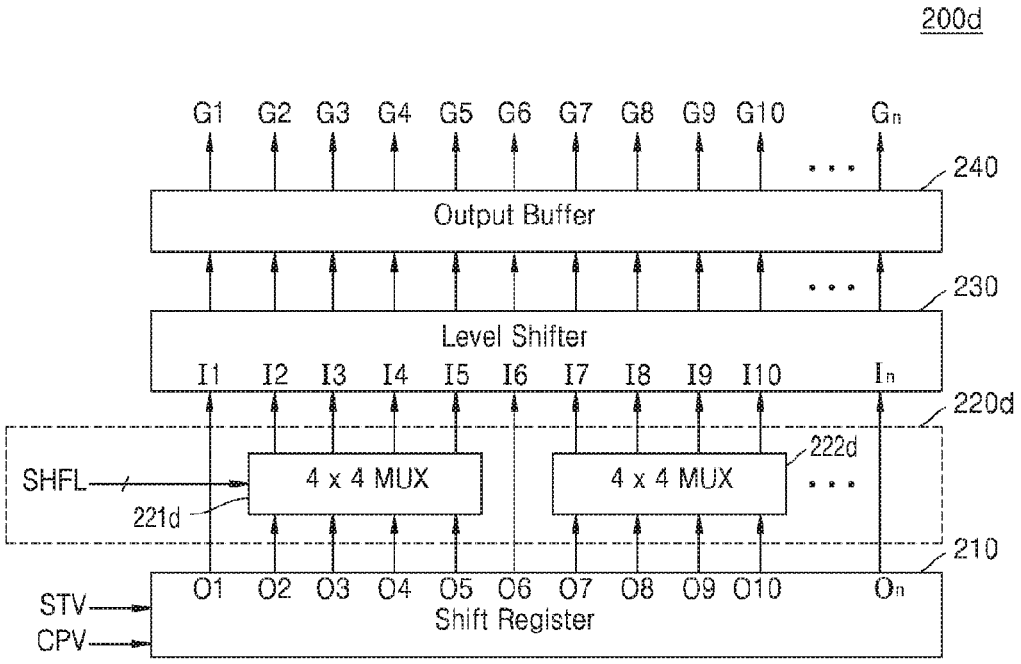
FIG. 15 is a block diagram illustrating another implementation example of the gate driver of FIG. 1.

FIG. 15 is a block diagram illustrating another implementation example of the gate driver 200 of FIG. 1.

Referring to FIG. 15, a gate driver 200*d* may include a shift register 210, a multiplexer 220*d*, a level shifter 230, and an output buffer 240.

Operations of the shift register 210, multiplexer 220*d*, level shifter 230, and output buffer 240 of FIG. 15 are similar to those of the shift register 210, multiplexer 220*a* or 220*c*, level shifter 230, and output buffer 240 of FIGS. 9A and 9B. However, in FIG. 15, some outputs O1, O6, O11, . . . of outputs O1 to On of the shift register 210 may be directly connected to corresponding inputs I1, I6, I8, . . . of the level shifter 230 without passing through multiplexers 221*d* and 222*d*. In this case, the selection control logic unit 110 of FIG. 1 may set a first gate line G1 and a sixth gate line G6 as reference gate lines, compare image data corresponding to second through fifth gate lines G2 to G5 with image data corresponding to the first gate line G1, compare image data corresponding to seventh through tenth gate lines G7 to G10 with image data corresponding to the sixth gate line G6, and generate a selection control signal SHFL based on comparison results. Selection control operations for groups including a plurality of gate lines, for example, a first group including the second through fifth gate lines G2 to G5 and a second group including the seventh through tenth gate lines G7 to G10, may be sequentially performed or performed in parallel. When the selection control operations are performed in parallel, a time that is required for setting the driving order for the plurality of gate lines may be reduced.

In FIG. 15, although the multiplexers 221*d* and 222*d* are 4×4 multiplexers, the inventive concept is not limited thereto. The multiplexers 221*d* and 222*d* may be N×N multiplexers, where 'N' is an integer greater than 1, but less than (n/2).

Figure 16:
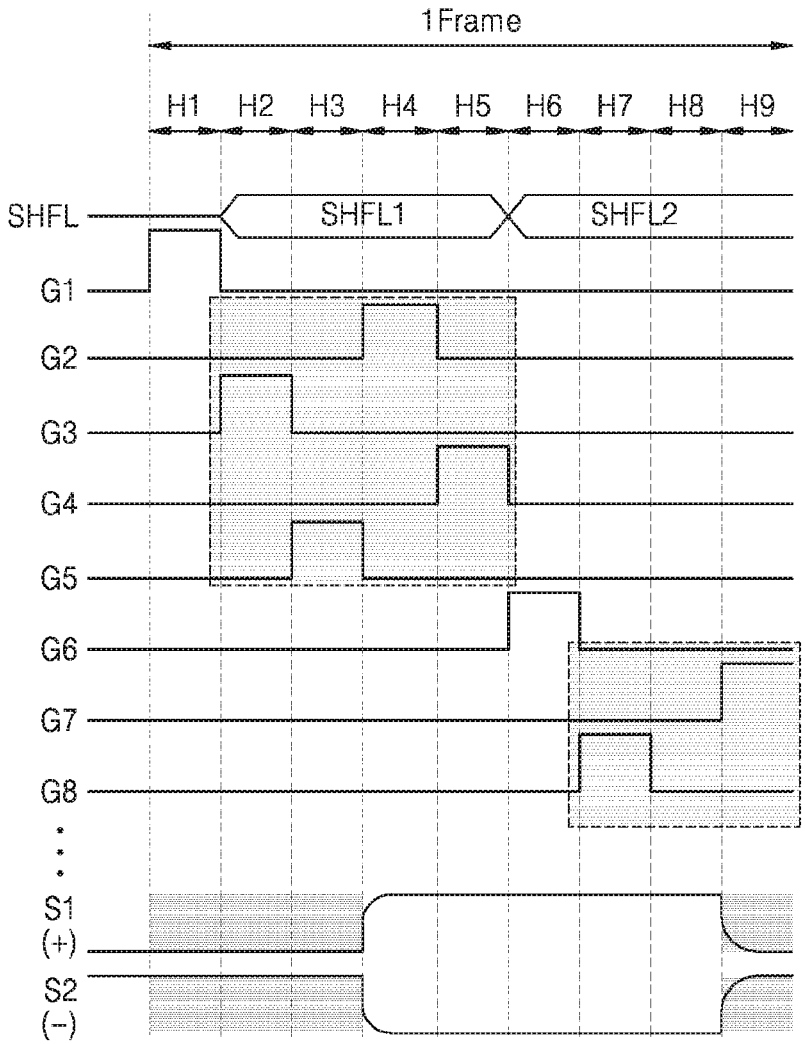
FIG. 16 illustrates waveforms of signals when a display device including the gate driver of FIG. 15 displays the image pattern of FIG. 10.

FIG. 16 illustrates waveforms of signals when the display device 1000 including the gate driver 200*d* of FIG. 15 displays the image pattern of FIG. 10.

Referring to FIG. 16, the driving order for first through eighth gate lines G1 to G8 may be changed in four gate line units in response to a selection control signal SHFL consisting of a plurality of bits. The first and sixth gate lines G1 and G6 are set in advance to be selected first and sixth, respectively. The driving order for the second through fifth gate lines G2 to G5 may be set based on a result of image data comparison with the first gate line G1. In addition, the driving order for the seventh through tenth gate lines G7 to G10 may be set based on a result of image data comparison with the sixth gate line G1. After the first gate line G1 is selected, the third gate line G3 and fifth gate line G5 having the same image data as the first gate line G1 from among the second through fifth gate lines G2 to G5 may be selected first. In the second horizontal line period H2 and third horizontal line period H3, a change of an image signal does not occur at source lines S1 and S2. As the second gate line G2 corresponding to a white image is selected after the third horizontal line period H3, a change of an image signal occurs at the source lines S1 and S2 in a fourth horizontal line period H4. Accordingly, the output of the source driver 300 of FIG. 1 transitions.

After the fourth gate line G4 is selected fifth, the sixth gate line G6 may be selected. Next, the eight gate line G8 and the tenth gate line (not shown) which have the same image data as the sixth gate line G6 may be selected. And then, since the seventh gate line G7 corresponding to a black image is selected, a change of an image signal may occur at the source lines S1 and S2 in a ninth horizontal line period H9.

Figure 17:
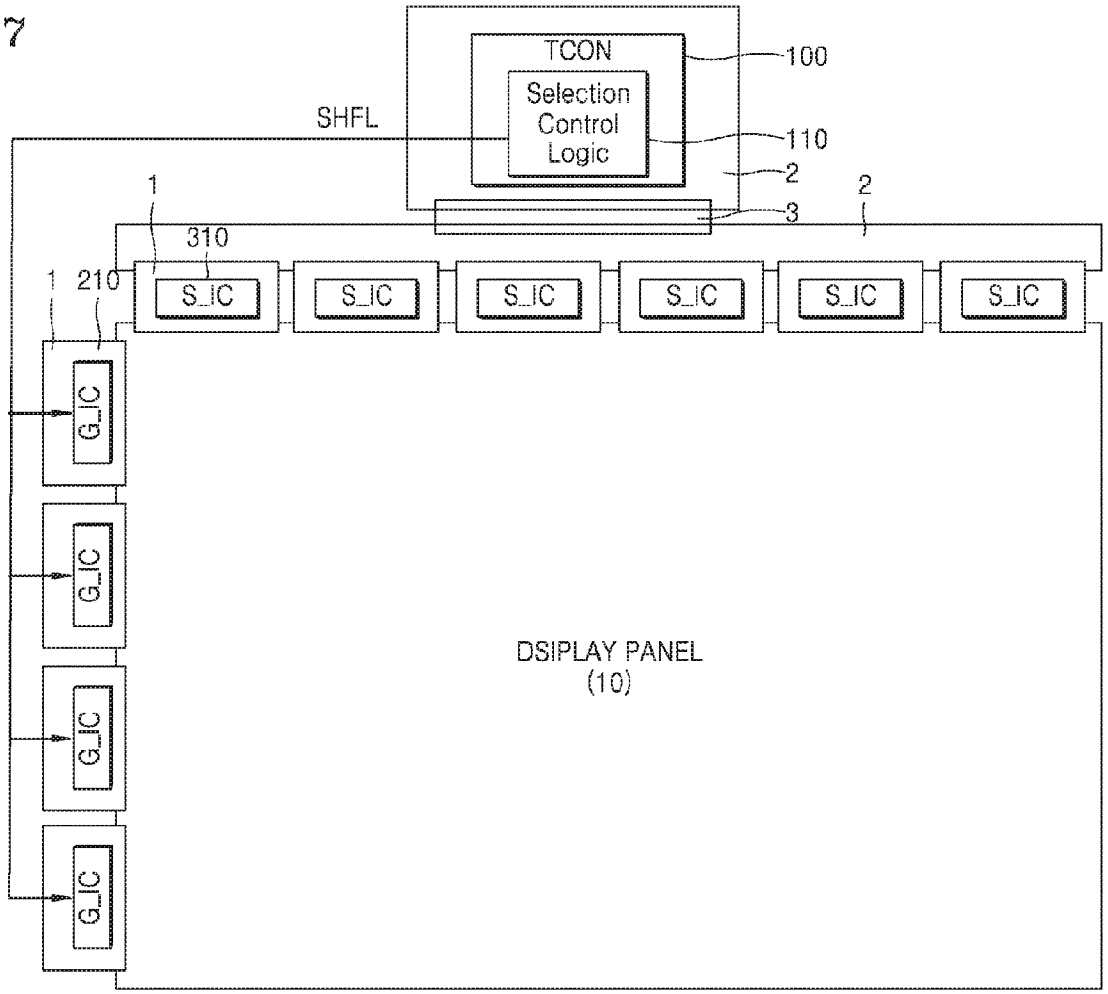
FIG. 17 is a diagram illustrating an implementation example of a display module including the display device of FIG. 1, according to an exemplary embodiment.

FIG. 17 is a diagram illustrating an implementation example of a display module including the display device 1000, according to an exemplary embodiment.

In the display module of FIG. 17, a display driver circuit (i.e., the display driver circuit 20 of FIG. 1) may be implemented by a plurality of semiconductor chips. Specifically, a source driver (i.e., the source drive 300 of FIG. 1) may be implemented by a plurality of source driving chips 310, and a gate driver (i.e., the gate drive 200 of FIG. 1) may be implemented by a plurality of gate driving chips 210. A timing controller 100 (i.e., the timing controller 100 of FIG. 1) may be implemented by one semiconductor chip or a plurality of semiconductor chips.

The plurality of source driving chips 310 and the plurality of gate driving chips 210 may be mounted on films 1 and be connected to a display panel 10. The plurality of source driving chips 310 may be connected to an upper portion or lower portion of the display panel 10. The plurality of gate driving chips 210 may be connected to a left portion or right portion of the display panel 10.

The timing controller 100 may be mounted on a printed circuit board 2 and transmit signals to the plurality of source driving chips 310 and the plurality of gate driving chips 210 through a connector 3 and the printed circuit board 2. The timing controller 100 includes a selection control logic 110. The selection control logic 110 may select the driving order for the gate lines by comparing image data portions associated with the gate line units and generate a selection control signal SHFL indicating the order of selection. The timing controller 100 provides the selection control signal SHFL to the plurality of gate driving chips 210.

The display module of FIG. 17 may be mounted on medium-sized or large-sized electronic devices, such as televisions, monitors, and electric bulletin boards.

Figure 18:
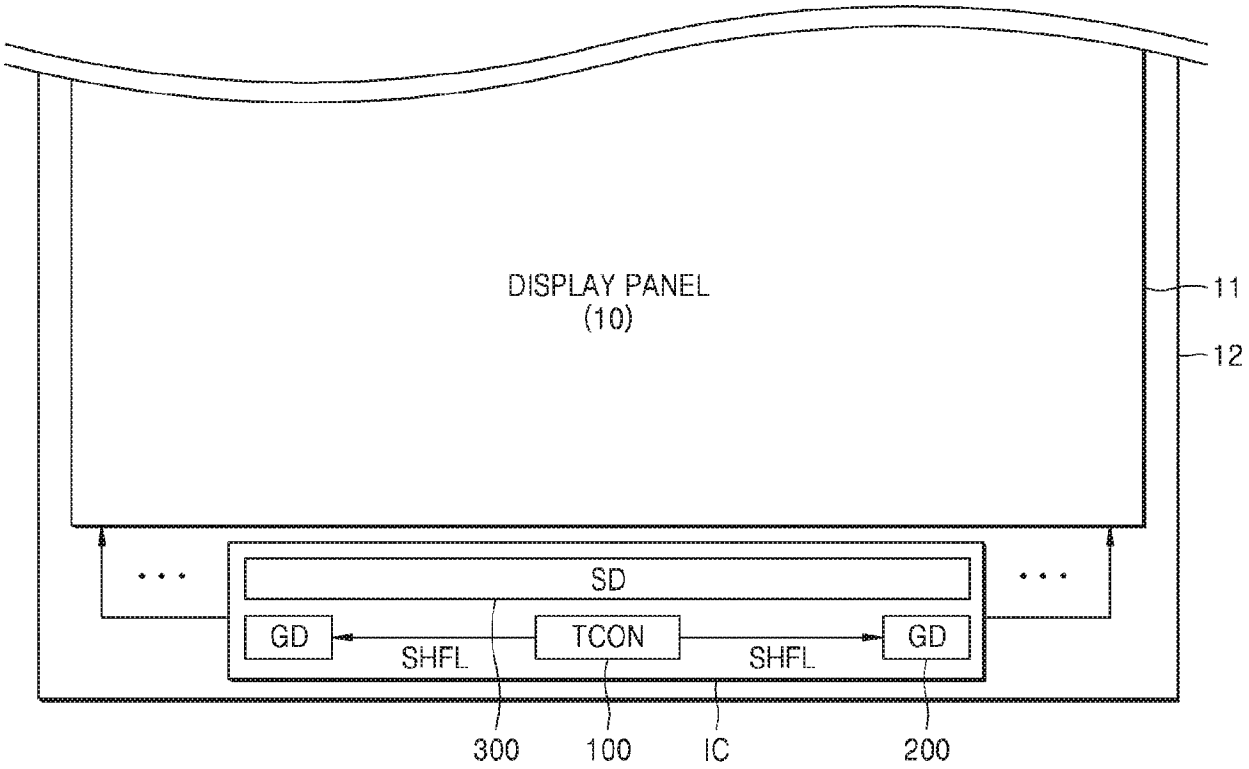
FIG. 18 is a diagram illustrating another implementation example of a display module including the display device of FIG. 1, according to an exemplary embodiment.

FIG. 18 is a diagram illustrating another implementation example of a display module including the display device 1000, according to an exemplary embodiment.

In the display module of FIG. 18, a display driver circuit (i.e., the display driver circuit 20 of FIG. 1) may be implemented by a single semiconductor chip IC or a plurality of semiconductor chips IC. The semiconductor chip IC, in which the display driver circuit, e.g., a timing controller 100, a gate driver 200, and a source driver 300, is integrated, may be mounted, in a chip on glass (COG) form, on a lower substrate 12 in which a display panel 10 is formed. Signals output from the semiconductor chip IC, for example, a source line driving signal and a gate line driving signal, may be provided to the display panel 10 via interconnection lines patterned on the lower substrate 12. The timing controller 100 may select the driving order for the gate lines by comparing image data portions associated with the gate line units and generate a selection control signal SHFL indicating the order of selection. The timing controller 100 provides the selection control signal SHFL to the gate driver 200.

The display module of FIG. 18 may be mounted on small-sized or medium-sized electronic devices, such as smartphone, tablet PC and smart watch.

Figure 19:
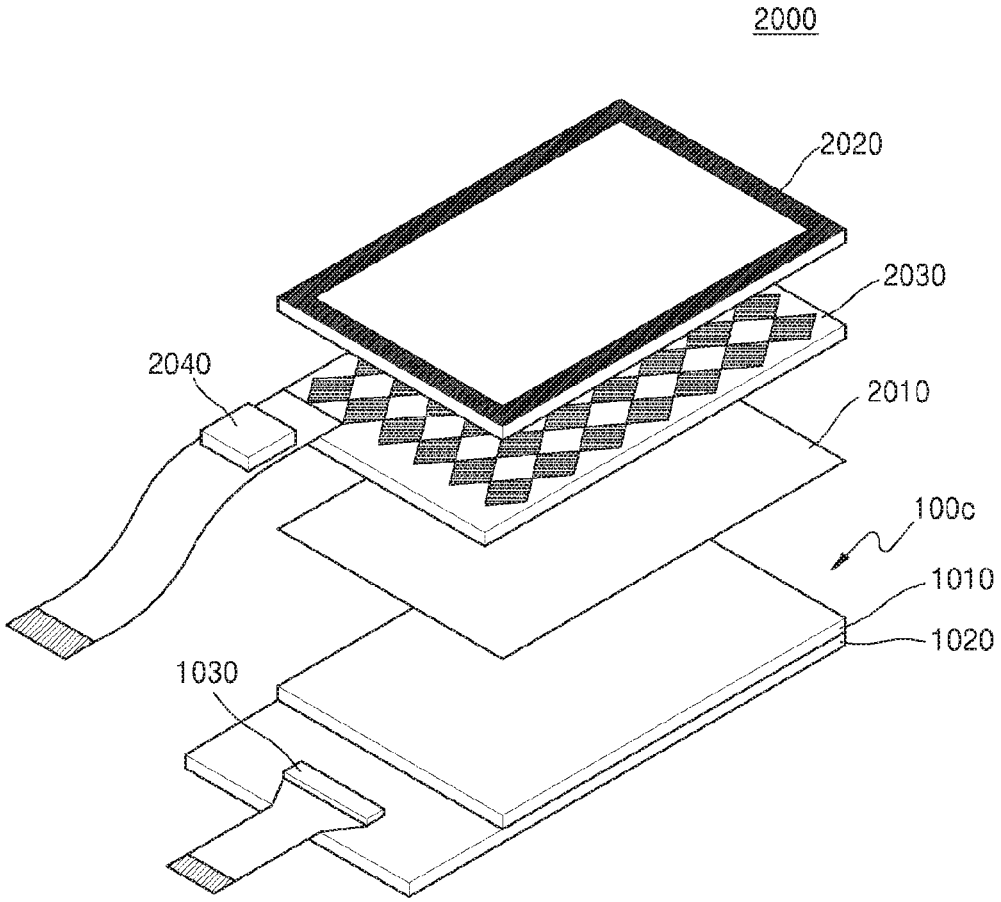
FIG. 19 is a diagram illustrating a touch screen module according to an exemplary embodiment.

FIG. 19 is a diagram illustrating a touch screen module 2000 according to an embodiment of the inventive concept.

Referring to FIG. 19, the touch screen module 2000 may include a display device 1000, a polarizing plate 2010, a touch panel 2030, a touch controller 2040, and a window glass 2020. The display device 1000 may include a display panel 1010, a printed board 1020, and a display driver circuit 1030. The display device 1000 illustrated in FIG. 19 may be the display device 1000 according to the exemplary embodiment, described with reference to FIGS. 1 through 16.

The window glass 2020 is formed of acryl or enhanced glass to protect the touch screen module 2000 against external shock or scratches caused by repetitive touches. The polarizing plate 2010 may be provided in order to improve an optical characteristic of the display panel 1010. The display panel 1010 may be formed by patterning a transparent electrode on the printed board 1020. The display panel 1010 may include a plurality of pixels for displaying a frame. In an exemplary embodiment, the display panel 1010 may be a liquid crystal panel. However, the inventive concept is not limited thereto. The display panel 1010 may include various kinds of display devices. For example, the display panel 1010 may be one selected from an organic light emitting diode (OLED), an electrochromic display (ECD), a digital mirror device (DMD), an actuated mirror device (AMD), a grating light value (GLV), a plasma display panel (PDP), an electroluminescent display (ELD), a light emitting diode (LED) display, and a vacuum fluorescent display (VFD).

The display driver circuit 1030 may include the display driver circuit 20 according to the above-described exemplary embodiment. According to the current exemplary embodiment, the display driver circuit 1030 is illustrated as being one chip for the sake of convenience. However, the display driver circuit 1030 may be formed of a plurality of chips. In addition, the display driver circuit 1030 may be mounted on a glass printed board in a chip on glass (COG) type. However, the above is only an exemplary embodiment. The display driver circuit 1030 may be mounted on the glass printed board in various types such as a chip on film (COF) type and a chip on board (COB) type.

As described above, the touch screen module 2000 may include the touch panel 2030 and the touch controller 2040. The touch panel 2030 may be formed by patterning a transparent electrode such as indium tin oxide (ITO) on a glass substrate or a polyethylene terephthalate (PET) film. In an embodiment, the touch panel 2030 may be formed on the display panel 1010. For example, a pixel of the touch panel 2030 may be merged with a pixel of the display panel 1010. The touch controller 2040 senses generation of a touch on the touch panel 2030, calculates touch coordinates, and transmits the calculated touch coordinates to a host (not shown). The touch controller 2040 may be integrated into one semiconductor chip together with the display driver circuit 1030.

Figure 20:
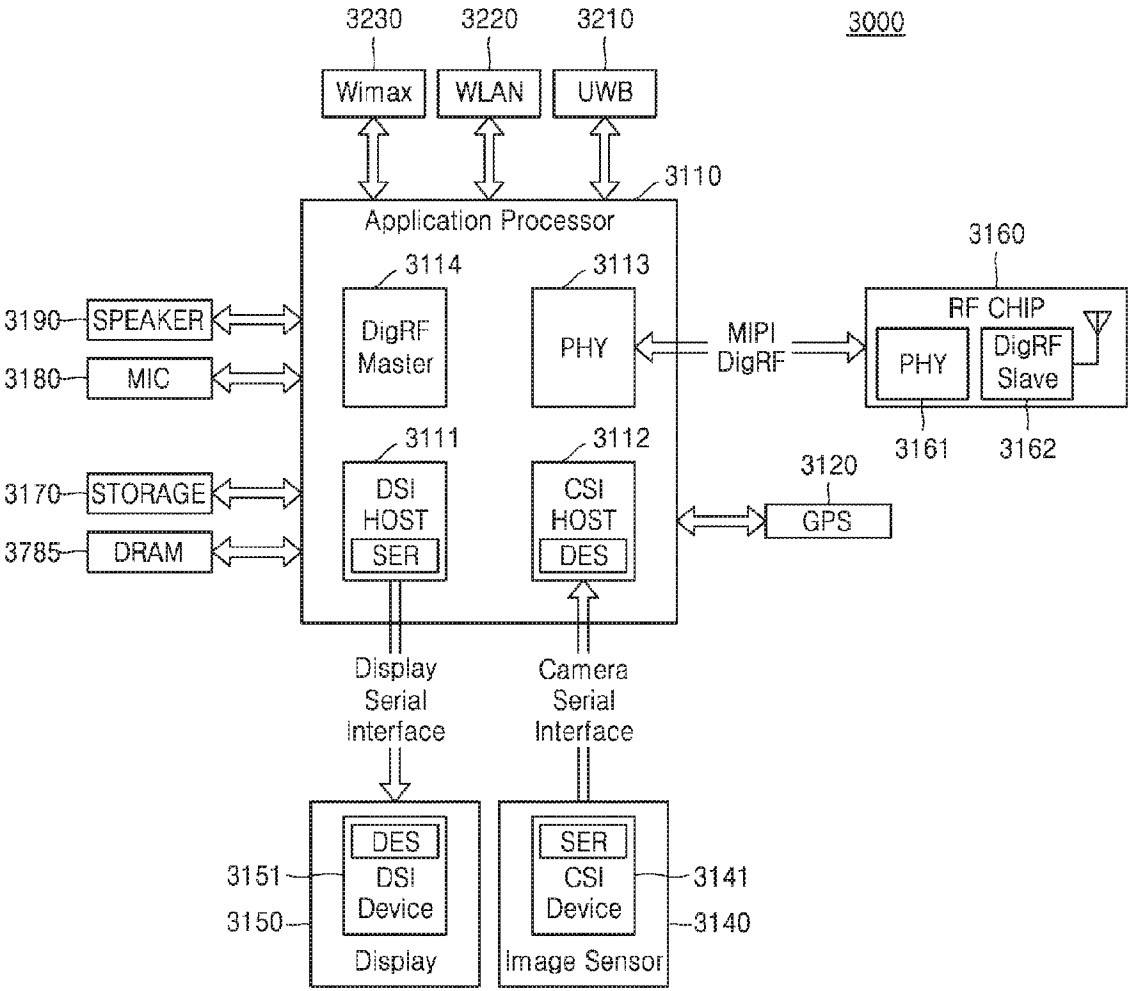
FIG. 20 is a block diagram of an electronic system including the display device of FIG. 1, according to an exemplary embodiment.

FIG. 20 is a block diagram of an electronic system 3000 including the display device 1000 according to an embodiment of the inventive concept.

Referring to FIG. 20, the electronic system 3000 may be implemented as a data processing apparatus that may use or support an MIPI interface, for example, a mobile phone, a PDA, a PMP, or a smart phone.

The electronic system 3000 includes an application processor 3110, an image sensor 3140, and a display device 3150. The display device 3150 may be the display device 1000 according to the above-described embodiment.

A camera serial interface (CSI) host 3112 implemented in the application processor 3110 may serially communicate with a CSI device 3141 of the image sensor 3140 through a CSI. In this case, for example, an optical deserializer may be implemented in the CSI host 3112 and an optical serializer may be implemented in the CSI device 3141.

A display serial interface DSI host 3111 implemented in the application processor 3110 may serially communicate with a DSI device 3151 of the display 3150 through a DSI. In this case, for example, an optical serializer may be implemented in the DSI host 3111 and an optical deserializer may be implemented in the DSI device 3151.

The electronic system 3000 may further include an radio frequency (RF) chip 3160 that may communicate with the application processor 3110. A physical layer protocol (PHY) 3113 of the electronic system 3000 and a PHY 3160 of the RF chip 3160 may send data to each other and receive data from each other, according to MIPI DigRF interface.

The electronic system 3000 may further include a global positioning system (GPS) 3120, a storage 3170, a mike 3180, a dynamic random access memory (DRAM) 3785, and a speaker 3190 and may communicate by using a Wimax 3230, a wireless local area network (WLAN) 3220, and an ultra wideband (UWB) 3210.

Figure 21:
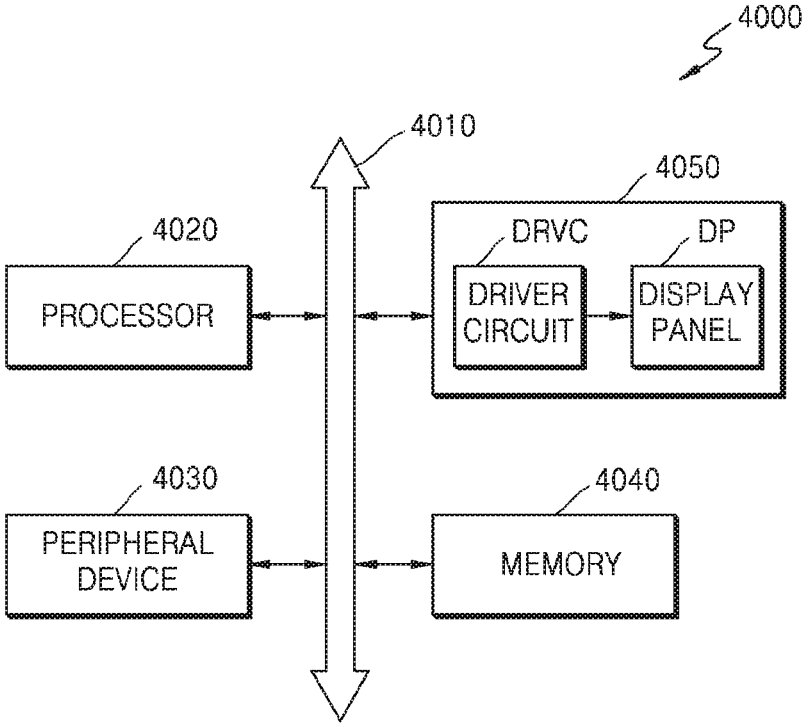
FIG. 21 is a block diagram of a display system according to an exemplary embodiment.

FIG. 21 is a block diagram of a display system 4000 according to an exemplary embodiment.

Referring to FIG. 21, the display system 4000 may include a processor 4020 electrically connected to a system bus 4010, a display device 4050, a peripheral device 4030, and a memory 4040.

The processor 4020 controls input and output of data of the peripheral device 4030, the memory 4040, and the display device 4050 and may process image data transmitted among the devices. The display device 4050 includes a display panel DP and a display driver circuit DRVC and stores image data applied through the system bus 4010 in a frame memory or a line memory included in the display driver circuit DRVC and displays the stored image data on the display panel DP. The display device 4050 may be the display device 1000 of FIG. 1. The display driver circuit DRVC may include the display driver circuit 20 of FIG. 1.

The peripheral device 4030 may be a device for converting moving pictures or still images of a camera, a scanner, and a web camera into electrical signals. The image data obtained through the peripheral device 4030 may be stored in the memory 4040 or may be displayed on a panel of the display device 4050 in real time. The memory 4040 may include a volatile memory device such a dynamic random access memory (DRAM) and/or a non-volatile memory device such as a flash memory. The memory 4040 may be a DRAM, a parameter RAM (PRAM), a magneto-resistive RAM (MRAM), a resistive RAM (ReRAM), a ferroelectric RAM (FRAM), a NOR flash memory, a NAND flash memory, or a fusion flash memory (for example, a memory obtained by combining a static RAM (SRAM) buffer, a NAND flash memory, and a NOR interface logic unit). The memory 4040 stores image data obtained by the peripheral device 4030 or may store image signals processed by the processor 4020.

The display system 4000 according to the current exemplary embodiment may be provided in an electronic product such as a tablet PC or a TV. However, the inventive concept is not limited thereto. The display system 4000 may be provided in various kinds of electronic products that display images.

While the inventive concept has been particularly shown and described with reference to embodiments thereof, it will be understood that various changes in form and details may be made therein without departing from the scope of the following claims.

What is claimed is:

1. A display driver circuit, comprising:

a gate driver configured to select and drive a plurality of gate lines of a display panel according to a driving order, wherein the plurality of gate lines is disposed in an ordered arrangement within the display panel;

a source driver configured to convert image data corresponding to a selected gate line into an image signal and output the image signal to a source line of the display panel; and a timing controller configured to:

calculate N comparison values by comparing a first image data portion corresponding to a first gate line with N image data portions respectively corresponding to N gate lines of the plurality of gate lines, where 'N' is an integer greater than or equal to 2, select a maximum comparison value from the N comparison values, set the driving order for the N gate lines to be a sequential driving order with respect to the ordered arrangement of the plurality of gate lines, regardless of the respective values of the N comparison values, when the maximum comparison value of the N comparison values is less than a predetermined threshold value, and set the driving order for the N gate lines to be a non-sequential driving order with respect to the ordered arrangement of the plurality of gate lines in accordance with the respective values of the N comparison values, when the maximum comparison value of the N comparison values is equal to or greater than the predetermined threshold value.

2. The display driver circuit of claim 1, wherein the timing controller is further configured to arrange the respective values of the N comparison values in an ascending order beginning with a lowest comparison values and extending to a highest comparison value, and to set the non-sequential driving order to correspond to the ascending order of the N comparison values, when the maximum value of the N comparison values is equal to or greater than the predetermined threshold value.

3. The display driver circuit of claim 1, wherein the timing controller is further configured to generate a selection control signal indicating the driving order for the plurality of gate lines and provide the selection control signal to the gate driver.

4. The display driver circuit of claim 1, wherein the timing controller comprises a selection control logic unit configured to respectively compare the first image data portion with each one of the N image data portions and generate a selection control signal indicating the driving order for the N gate lines.

5. The display driver circuit of claim 4, wherein the timing controller is further configured to receive externally provided image data, determine whether or not the externally provided image data is still image data, and upon determining that the externally provided data is not still image data, blocking operation of the selection control logic unit and setting the driving order to be the sequential driving order with respect to the ordered arrangement of the plurality of gate lines, regardless of the respective values of the N comparison values.

6. The display driver circuit of claim 4, wherein the timing controller is further configured to receive externally provided image data, determine whether or not the externally provided image data is still image data, and upon determining that the externally provided data is still image data, using the selection control logic unit to set the non-sequential driving order with respect to the ordered arrangement of the plurality of gate lines in accordance with the respective values of the N comparison values.

7. The display driver circuit of claim 6, wherein the timing controller is further configured to arrange the respective values of the N comparison values in an ascending order beginning with a lowest comparison values and extending to a highest comparison value, and set the non-sequential driving order in accordance with the ascending order of the N comparison values.

8. The display driver circuit of claim 1, wherein the timing controller is further configured to calculate N additional comparison values by comparing image data corresponding to a gate line selected last from among the N gate lines with image data corresponding to each of another N gate lines selected after the N gate lines, and to determine the order of selection such that the other N gate lines are selected depending on an order of ascending comparison values.

9. The display driver circuit of claim 8, wherein the timing controller sequentially provides a first selection control signal indicating the order of selection of the N gate lines and a second selection control signal indicating the order of selection of the other N gate lines to the gate driver.

10. The display driver circuit of claim 1, wherein upon determining that two of the N comparison values, respectively corresponding to a second gate line and a third gate line among the plurality of gate lines, are equal, the timing controller is further configured to assign one of the second gate line and third gate line to an earlier position in the non-sequential driving order than the other one of the second gate line and third gate line, wherein the one of the second gate line and third gate line is closer to the first gate line than the other one of the second gate line and third gate line in the ordered arrangement.

11. The display driver circuit of claim 1, wherein the gate driver comprises:

a shift register configured to generate a plurality of shift pulses;

a level shifter configured to shift voltage levels of the plurality of shift pulses and to output signals having shifted voltage levels;

an output buffer configured to generate a plurality of scan pulses based on the signals output from the level shifter and provide the plurality of scan pulses to the plurality of gate lines; and a multiplexer configured to receive a selection control signal indicating the driving order for the plurality of gate lines from the timing controller and set a connection relation between a plurality of outputs of the shift register and a plurality of inputs of the level shifter in response to the selection control signal.

12. A gate driver for driving a plurality of gate lines of a display panel in response to image data to display an image on the display panel, the gate driver comprising:

a shift register that generates a plurality of shift pulses;

a level shifter that shifts voltage levels of the plurality of shift pulses and outputs signals having shifted voltage levels;

an output buffer that provides the signals output from the level shifter to the plurality of gate lines; and first and second multiplexers which set a connection relation between a plurality of outputs of the shift register and a plurality of inputs of the level shifter in response to first and second selection control signals which vary according to an image data pattern determined for the image data, wherein the first multiplexer operates in response to the first selection control signal, and the second multiplexer operates in response to the second selection control signal, and wherein the second selection control signal is received after the first multiplexer transmits N shift pulses to the level shifter.

13. The gate driver of claim 12, wherein the first multiplexer comprises an N×N multiplexer connected to N outputs of the shift register and N inputs of the level shifter, where 'N' is an integer greater than or equal to 2.

14. The gate driver of claim 12, wherein the selection control signal is a digital signal including a plurality of bits.

15. A method of driving a plurality of gate lines of a display panel, wherein the plurality of gate lines is disposed in an ordered arrangement, the method comprising:

receiving image data;

converting image data corresponding to a selected gate line into an image signal and outputting the image signal to a source line of the display panel;

determining N comparison values by comparing a first image data portion corresponding to a first gate line with N image data portions respectively corresponding to N gate lines of the plurality of gate lines, where 'N' is an integer greater than or equal to 2;

selecting a maximum comparison value from the N comparison values;

setting a driving order for the N gate lines to be a sequential driving order with respect to the ordered arrangement of the plurality of gate lines, regardless of the respective values of the N comparison values, when the maximum comparison value of the N comparison values is less than a predetermined threshold value;

setting the driving order for the N gate lines to be a non-sequential driving order with respect to the ordered arrangement of the plurality of gate lines in accordance with the respective values of the N comparison values, when the maximum comparison value of the N comparison values is equal to or greater than the predetermined threshold value; and driving the plurality of gate lines of the display panel according to the driving order.

16. The method of claim 15, further comprising, when the maximum value of the N comparison values is equal to or greater than the predetermined threshold value:

arranging the respective values of the N comparison values in an ascending order beginning with a lowest comparison values and extending to a highest comparison value; and setting the non-sequential driving order to correspond to the ascending order of the N comparison values.

17. The method of claim 15, further comprising:

determining N additional comparison values by comparing image data corresponding to a gate line selected last from among the N gate lines with image data corresponding to each of another N gate lines selected after the N gate lines; and determining the order of selection such that the other N gate lines are selected depending on an order of ascending comparison values.

18. The method of claim 15, further comprising:

upon determining that two of the N comparison values, respectively corresponding to a second gate line and a third gate line among the plurality of gate lines, are equal, assigning one of the second gate line and third gate line to an earlier position in the non-sequential driving order than the other one of the second gate line and third gate line, wherein the one of the second gate line and third gate line is closer to the first gate line than the other one of the second gate line and third gate line in the ordered arrangement.

* * * * *